US011745054B2

(12) United States Patent
Mills et al.

(10) Patent No.: US 11,745,054 B2
(45) Date of Patent: Sep. 5, 2023

(54) EXERCISE DEVICE

(71) Applicant: MILLZ, Inc., San Francisco, CA (US)

(72) Inventors: Jessica Mills, San Francisco, CA (US); Soren Mills, San Francisco, CA (US); Jennifer O'Griffin, San Francisco, CA (US); Mose O'Griffin, San Francisco, CA (US); Andrew Sebastian, Petaluma, CA (US); Jonathan Thomas Johnson, Atlanta, GA (US)

( * ) Notice: Subject to any disclaimer, the term of this patent is extended or adjusted under 35 U.S.C. 154(b) by 0 days.

(21) Appl. No.: 17/066,467

(22) Filed: Oct. 8, 2020

(65) Prior Publication Data

US 2022/0008781 A1 Jan. 13, 2022

Related U.S. Application Data

(63) Continuation-in-part of application No. 16/436,907, filed on Jun. 10, 2019, now abandoned, which is a (Continued)

(51) Int. Cl.
*A63B 22/20* (2006.01)
*A63B 22/16* (2006.01)
(Continued)

(52) U.S. Cl.
CPC ..... *A63B 22/20* (2013.01); *A63B 21/023* (2013.01); *A63B 21/0435* (2013.01);
(Continued)

(58) Field of Classification Search
CPC ..... A63B 21/0004; A63B 21/00058; A63B 21/00069; A63B 21/00076;
(Continued)

(56) References Cited

U.S. PATENT DOCUMENTS 266,978 A * 11/1882 Darrow ..... A63C 17/12 280/11.115
1,824,920 A 9/1931 Novak
(Continued)

FOREIGN PATENT DOCUMENTS

CN 106075821 A * 11/2016 ..... A63B 21/0722
CN 106139525 A * 11/2016 ..... A63B 22/203
(Continued)

OTHER PUBLICATIONS

"Actuator", Merriam-Webster.com, 2017, available at https://www.merriam-webster.com/dictionary/actuator, accessed May 9, 2017.
(Continued)

*Primary Examiner* — Gary D Urbiel Goldner
(74) *Attorney, Agent, or Firm* — Joseph M. Kobzeff

(57) ABSTRACT

An exercise device is described. An exercise device includes a body, the body having a top, a bottom, a first end located at one edge of the body, a second end located at an opposite edge of the body, and first and second sides extending between the first and second ends; one or more wheels; and an energy storage device applying resistive and restoring force to the one or more wheels. Optionally, a shaft can be present that rotationally locks two or more of the wheels.

21 Claims, 24 Drawing Sheets

Related U.S. Application Data continuation of application No. PCT/US2017/031838, filed on May 9, 2017, which is a continuation of application No. 15/590,983, filed on May 9, 2017, now Pat. No. 9,993,686.

(60) Provisional application No. 62/432,255, filed on Dec. 9, 2016.

(51) Int. Cl.

| | |
|---|---|
| ***A63B 21/02*** | (2006.01) |
| ***A63B 21/04*** | (2006.01) |
| ***A63B 21/045*** | (2006.01) |
| ***A63B 23/02*** | (2006.01) |
| ***A63B 23/035*** | (2006.01) |
| ***A63B 21/00*** | (2006.01) |

(52) U.S. Cl.

CPC ..... *A63B 21/0455* (2013.01); *A63B 22/16* (2013.01); *A63B 23/0216* (2013.01); *A63B 23/0355* (2013.01); *A63B 23/03525* (2013.01); *A63B 21/4034* (2015.10); *A63B 2208/0219* (2013.01); *A63B 2208/0228* (2013.01); *A63B 2208/0295* (2013.01)

(58) Field of Classification Search

CPC ..... A63B 21/00178; A63B 21/005; A63B 21/0051; A63B 21/0052; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/22; A63B 21/4027; A63B 21/4033; A63B 21/4034; A63B 22/0046; A63B 22/16; A63B 22/18; A63B 22/20; A63B 22/201; A63B 22/203; A63B 23/02; A63B 23/0205; A63B 23/0211; A63B 23/0216; A63B 23/0222; A63B 23/035; A63B 23/03516; A63B 23/03525; A63B 23/0355; A63B 23/03575; A63B 23/04; A63B 23/12; A63B 23/1209; A63B 23/1236; A63B 71/0054; A63B 2071/0063; A63B 2071/0072; A63B 2208/0214; A63B 2208/0219; A63B 2208/0228; A63B 2208/0295

See application file for complete search history.

(56) References Cited

U.S. PATENT DOCUMENTS

| | | | | |
|---|---|---|---|---|
| 2,131,570 | A | 9/1938 | Riley | |
| 2,973,962 | A | 3/1961 | Griffin | |
| 3,403,906 | A | 10/1968 | Burzenski | |
| 3,752,475 | A | 8/1973 | Ott | |
| 4,136,867 | A | 1/1979 | Wilken | |
| 4,177,803 | A | 12/1979 | Papistas-Scherer | |
| 4,861,054 | A * | 8/1989 | Spital | A63C 17/015 280/11.115 |
| 4,911,440 | A | 3/1990 | Hyman | |
| 4,915,403 | A * | 4/1990 | Wild | A63C 17/12 280/258 |
| 5,004,229 | A | 4/1991 | Lind | |
| 5,280,935 | A * | 1/1994 | Sobocan | A63C 17/12 280/11.115 |
| 5,669,864 | A | 9/1997 | Brister | |
| 5,707,325 | A | 1/1998 | Chiou | |
| 6,017,296 | A | 1/2000 | Tang et al. | |
| 6,050,357 | A | 4/2000 | Staelin | |
| 6,053,853 | A | 4/2000 | Hinds | |
| 6,174,269 | B1 * | 1/2001 | Eschenbach | A63B 22/20 482/904 |
| 6,264,587 | B1 * | 7/2001 | Lee | A63B 22/20 252/62.3 R |
| 6,348,027 | B1 | 2/2002 | Lee | |
| D454,929 | S | 3/2002 | Huang | |
| 6,354,983 | B1 * | 3/2002 | Lee | A63B 21/0455 482/127 |
| 6,368,259 | B1 * | 4/2002 | Liao | A63B 23/0211 482/121 |
| 6,409,639 | B1 | 6/2002 | Kuo | |
| 6,500,105 | B1 | 12/2002 | Kuo | |
| 6,575,883 | B1 | 6/2003 | Hinds | |
| 6,585,627 | B2 | 7/2003 | Fernandez | |
| 6,761,611 | B2 | 7/2004 | Wood et al. | |
| 7,175,573 | B1 | 2/2007 | Huang | |
| 7,338,056 | B2 * | 3/2008 | Chen | A63C 17/016 280/87.041 |
| 7,600,768 | B2 * | 10/2009 | Chen | A63C 17/016 280/87.05 |
| 7,766,351 | B2 * | 8/2010 | Chen | A63C 17/012 280/87.021 |
| 7,837,603 | B1 | 11/2010 | Carnell | |
| 8,414,000 | B2 * | 4/2013 | Chen | A63C 17/016 280/87.021 |
| D697,148 | S | 1/2014 | Lin | |
| 8,641,585 | B2 | 2/2014 | LaGree | |
| 8,814,767 | B2 | 8/2014 | Brodbeck | |
| 9,011,303 | B2 | 4/2015 | MacColl | |
| 9,119,989 | B1 | 9/2015 | Lagree | |
| 9,132,315 | B1 * | 9/2015 | Chen | A63B 21/023 |
| 9,283,422 | B2 | 3/2016 | Lagree | |
| 9,393,454 | B2 | 7/2016 | Lagree | |
| 9,415,253 | B2 | 8/2016 | Lagree | |
| 9,457,225 | B2 | 10/2016 | Lagree | |
| 9,474,924 | B2 | 10/2016 | Lagree | |
| 9,474,927 | B2 | 10/2016 | Lagree | |
| 9,498,667 | B1 | 11/2016 | Lagree | |
| 9,522,299 | B2 | 12/2016 | Lagree | |
| 9,555,282 | B1 | 1/2017 | Lagree | |
| 9,579,536 | B1 | 2/2017 | Lagree | |
| 9,586,081 | B2 | 3/2017 | Lagree | |
| 9,604,095 | B1 | 3/2017 | Lagree | |
| 9,649,527 | B1 | 5/2017 | Lagree | |
| 9,717,945 | B2 | 8/2017 | Lagree | |
| 9,744,395 | B1 | 8/2017 | Lagree | |
| 9,868,010 | B2 | 1/2018 | Lagree | |
| 9,868,011 | B2 | 1/2018 | Lagree | |
| 9,868,018 | B2 | 1/2018 | Lagree | |
| 10,022,577 | B2 | 7/2018 | Lagree | |
| 10,118,067 | B2 | 11/2018 | Lagree | |
| 10,155,129 | B2 | 12/2018 | Lagree | |
| 10,201,724 | B2 | 2/2019 | Lagree | |
| 10,213,641 | B2 | 2/2019 | Lagree | |
| 10,702,730 | B2 | 7/2020 | Lagree | |
| 10,716,964 | B1 | 7/2020 | Lagree | |
| 10,744,370 | B1 | 8/2020 | Lagree | |
| 10,792,528 | B1 | 10/2020 | Lagree | |
| 10,857,420 | B2 | 12/2020 | Lagree | |
| 11,148,004 | B1 | 10/2021 | Lagree | |
| 11,161,001 | B1 | 11/2021 | Lagree | |
| 11,318,340 | B1 | 5/2022 | Lagree | |
| 11,446,562 | B2 * | 9/2022 | Desberg | A63C 17/014 |
| 2002/0025894 | A1 | 2/2002 | Fernandez | |
| 2002/0123416 | A1 | 9/2002 | Huang | |
| 2003/0013585 | A1 * | 1/2003 | Chen | A63B 21/153 482/115 |
| 2003/0017921 | A1 * | 1/2003 | Lee | A63B 22/20 482/136 |
| 2003/0022770 | A1 | 1/2003 | Lee | |
| 2003/0032536 | A1 | 2/2003 | Mabe et al. | |
| 2003/0103352 | A1 * | 6/2003 | Yu | A63B 23/03508 362/423 |
| 2003/0134716 | A1 | 7/2003 | Yu | |
| 2003/0158023 | A1 | 8/2003 | Yu | |
| 2010/0292060 | A1 | 11/2010 | Barufka | |
| 2010/0304941 | A1 | 12/2010 | Ota | |

(56) References Cited

U.S. PATENT DOCUMENTS

| | | | | |
|---|---|---|---|---|
| 2011/0143895 | A1* | 6/2011 | Tang | A63B 22/20 482/132 |
| 2011/0275482 | A1 | 11/2011 | Brodess et al. | |
| 2015/0182792 | A1 | 7/2015 | Maccoll | |
| 2016/0101314 | A1 | 4/2016 | Exley | |
| 2018/0161621 | A1* | 6/2018 | Mills | A63B 23/0216 |
| 2019/0290957 | A1* | 9/2019 | Mills | A63B 21/023 |
| 2020/0061446 | A1* | 2/2020 | Chuang | A63B 21/00185 |

FOREIGN PATENT DOCUMENTS

| | | | | | |
|---|---|---|---|---|---|
| CN | 106139526 | A | * | 11/2016 | A63B 22/203 |
| CN | 106139527 | A | * | 11/2016 | A63B 22/20 |
| CN | 106139529 | A | * | 11/2016 | A63B 21/00 |
| CN | 106166368 | A | * | 11/2016 | A63B 22/203 |
| CN | 106178415 | A | * | 12/2016 | A63B 21/00 |
| CN | 106267711 | A | * | 1/2017 | A63B 22/203 |

OTHER PUBLICATIONS

"Clutch", Merriam-Webster.com, 2017, available at https://www.merriam-webster.com/dictionary/clutch, accessed May 9, 2017.

"Wheel", Merriam-Webster.com, 2017, available at https://www.merriam-webster.com/dictionary/wheel, accessed May 9, 2017.

PCT International Search Report and Written Opinion from PCT/US2017/031838 dated Jul. 28, 2017.

PCT International Preliminary Report on Patentability from PCT/US2017/031838 dated Mar. 13, 2019.

Office Action issued for U.S. Appl. No. 15/590,983 dated Oct. 27, 2017.

Notice of Allowance issued for U.S. Appl. No. 15/590,983 dated Mar. 16, 2018.

Notice of Allowance issued for U.S. Appl. No. 16/43 6,907 dated Jul. 9, 2020.

PCT International Search Report from PCT/US2021/053843, dated Feb. 28, 2022.

PCT Written Opinion from PCT/US2021/053843, dated Feb. 28, 2022.

Wikipedia Entry for "Engine", available at https://en.wikipedia.org/wiki/Engine, accessed Apr. 3, 2023.

* cited by examiner

EXERCISE DEVICE

CROSS REFERENCE TO RELATED APPLICATIONS

This is a continuation-in-part of U.S. patent application Ser. No. 16/436,907 filed on Jun. 10, 2019, which is a continuation of International Patent Appl. No. PCT/US2017/031838 filed on May 9, 2017, which is a continuation of U.S. patent application Ser. No. 15/590,983 filed on May 9, 2017 (now U.S. Pat. No. 9,993,686 B1 issued on Jun. 12, 2018), which is a non-provisional of and claims the benefit and priority of U.S. Provisional Patent Appl. No. 62/432,255 entitled "EXERCISE PLATFORM" and filed on Dec. 9, 2016, the disclosures of which are incorporated herein by reference in their entireties.

TECHNICAL FIELD

This disclosure relates to exercise systems and devices including portable exercise devices that provide a resistance force or torque.

BACKGROUND

The present disclosure relates to exercise devices, such as can be used for various exercises to condition or strengthen various muscles, including the core, of a person. Exercise devices such as stationary machines, portable machines and small portable machines can be used for various exercise routines. Some exercise devices can provide a resistive force, such as through the use of springs, rubber bands, weights or gravity. Some exercise devices can be very sophisticated and provide a great deal of flexibility in performing a number of exercises, but be expensive to purchase and complicated to set-up and use.

One important group of muscles to exercise is frequently referred to as the "core." This group of muscles can include muscles of an individual's torso. In various definitions, the core can include one or more of the pelvic floor muscles, transversus abdominis, multifidus, internal and external obliques, rectus abdominis, erector spinae, longissimus thoracis, diaphragm, latissimus dorsi, gluteus maximum, trapezius, and other muscles as well. Having a strong core is believed to contribute to good posture and balance as well as decreasing back and joint pain, muscle fatigue, nerve pain and injury, improve blood circulation, blood pressure, personal energy and positive emotional outlook.

Exercises without exercise equipment can be used to provide general exercise, but exercise equipment can provide additional benefits to an exercise routine, such as to assist in improving form, improve targeting of individual muscles or muscle groups, facilitate a different/greater range of movement during the exercise and vary the resistance during the exercise as compared to exercise without equipment.

One option for individuals that would like to use exercise equipment during a workout would be to join a gym. However, gym memberships can be expensive and frequenting agent can be inconvenient. Purchasing exercise equipment can expensive and the equipment can be bulky. Accordingly, there is a need for compact and inexpensive exercise equipment which can assist in providing an improved exercise experience.

SUMMARY

In a first aspect, an exercise device is provided, the exercise device comprising: a body, the body having a top, a bottom, a first end located at one edge of the body, a second end located at an opposite end of the body, and first and second sides extending between the first and second ends; first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub; a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end; when the first and second wheels are rotated against respective first and second spring torques, energy is stored in the first and second springs and the first and second springs apply restoring torque to the first and second wheels, respectively.

In a second aspect, an exercise device is provided, the exercise device comprising: a body, the body having a top, a bottom, a first end located at one edge of the body, a second end located at an opposite end of the body, and first and second sides extending between the first and second ends; a first axle connected to a first wheel, the first axle also connected to the body proximate the first end at a first hub; a first spring having a first spring end, the first spring positioned at least partially within the first axle, with the first spring end slidably connected to one of the first wheel and the first hub at a first junction, wherein the first junction is configured to convey torque between the one of the first hub and the first wheel and the first spring end.

In a third aspect, a method of using an exercise device is provided, the method comprising: moving an exercise device away from a person's waist while the person's feet are placed on a body of the exercise device and the first and second wheels are on a surface, wherein when the exercise device is moved away from the person's waist, the first and second wheels rotate along the surface, and torque energy is stored in the first and second springs; and moving the exercise device toward the person's waist while the person is assisted by or resists torque supplied to the first and second wheels by the first and second springs, respectively, wherein the exercise device comprising: the body, the body having a top, a bottom, a first end located at one edge of the body, a second end located at an opposite end of the body, and first and second sides extending between the first and second ends; first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub; a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end; when the first and second wheels are rotated against respective first and second spring torques, energy is stored in the first and second springs and the first and second springs apply restoring torque to the first and second wheels, respectively.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1:
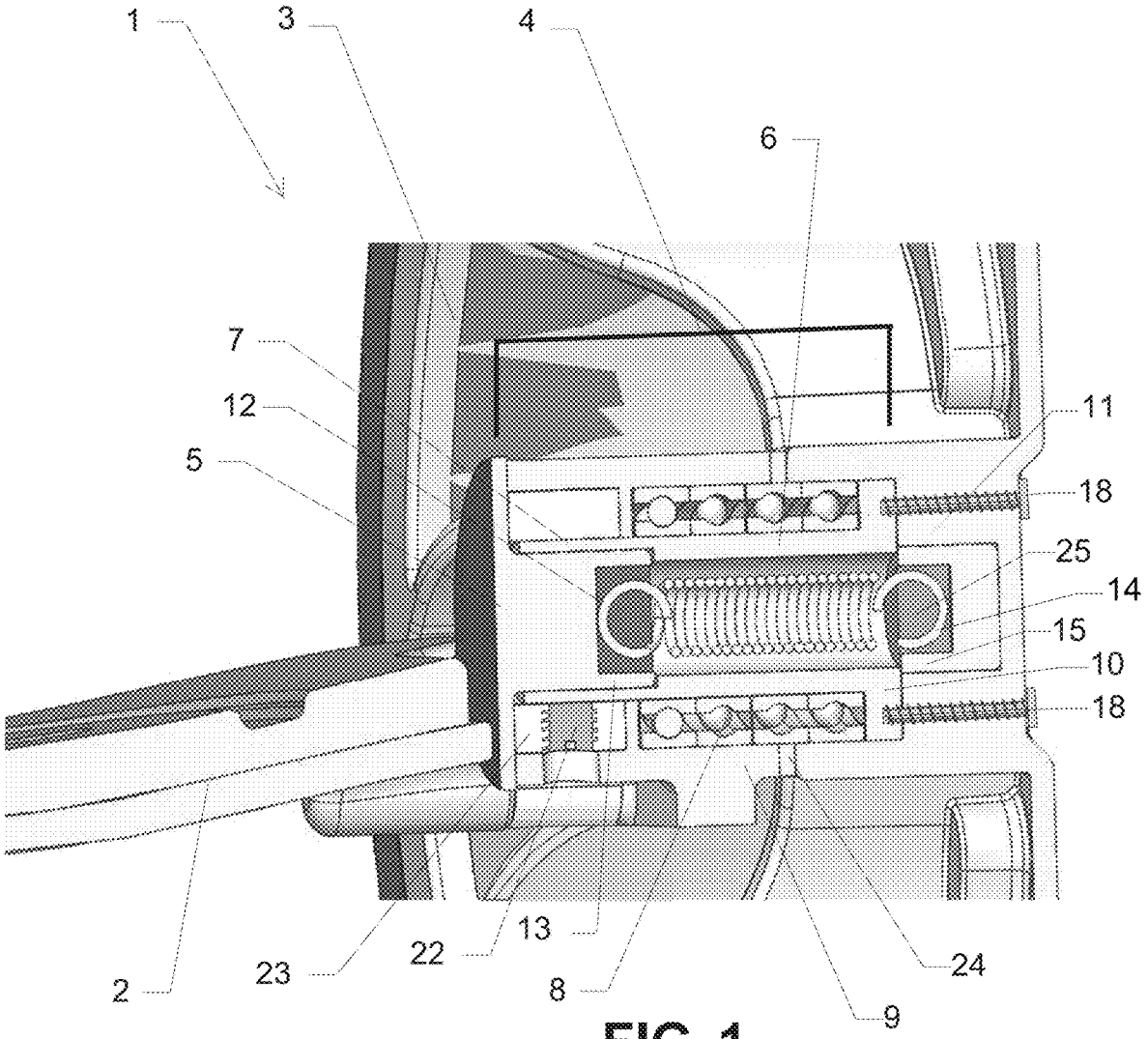
FIG. 1 shows an embodiment of an end of an exercise device.
Figure 2:
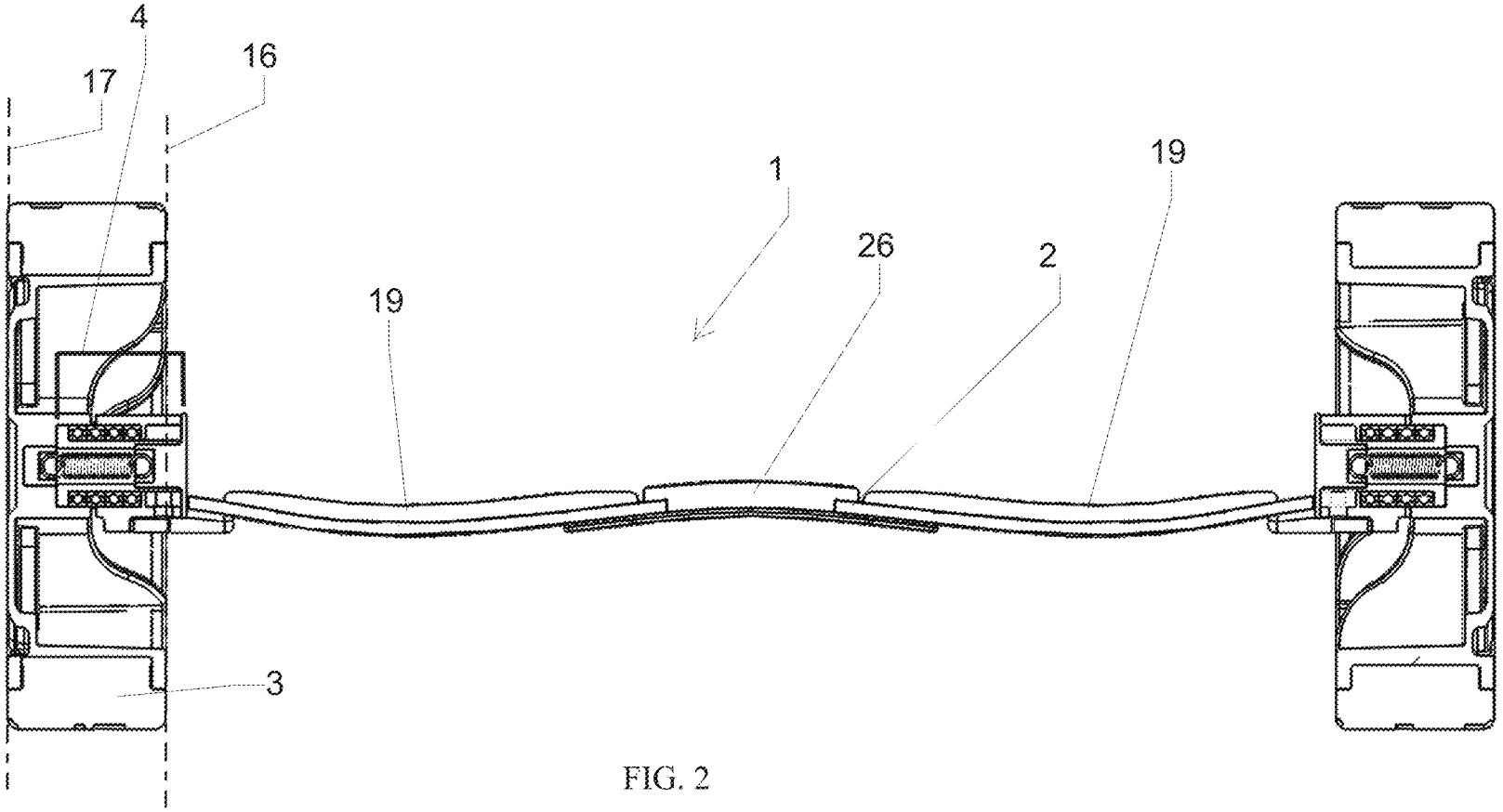
FIG. 2 shows an embodiment of an exercise device having two wheels.

In an embodiment of an exercise device 1, an exercise device can include a body 2 connected to a wheel 3 through a hub assembly 4 where the hub assembly is able to store torsional energy. In some embodiments, such as is shown in FIG. 1, the wheel 3 and hub assembly 4 can be proximate a first end of the body 2. In some embodiments, such as is shown in FIG. 2, an exercise device can include first and second wheels 3 attached to body 2 through respective first and second hub assemblies 4. In some embodiments, the first and second wheels and first and second hub assemblies 4 can be located proximate opposite ends of body 2, as shown in FIG. 2.

The hub assembly 4 can comprise a hub 5, axle 6 and spring 11. In one embodiment, as shown in FIG. 1, the hub 5 can be connected to an axle 6 at a hub end 7 of the axle 6, with the axle 6 extending outward from the hub 5. External to the axle 6 are one or more bearings 8 in contact with the axle 6 and providing a rotating connection between the axle 6 and the housing 9. Bearings 8 can be of any suitable type, such as ball, sleeve, bushing, roller, etc. The axle 6 connected to a wheel 3 at the wheel end 10 of the axle 6. Within axle 6 is located spring 11. Spring 11 has a hub end 12 ("spring hub end") connected to the hub junction 13 located on the hub 5, and a wheel end 14 ("spring wheel end") of spring 11 connected to the wheel junction 15 located on the wheel 3.

In some embodiments, one or both of the hub junction 13 and the wheel junction 15 are connected to their respective ends of spring 11 by way of sliding connections, such that wheel end 14 of spring 11 is slidably received into wheel junction 15 and/or hub end 12 of spring 11 is slidably received into hub junction 13. In some embodiments, a hub junction 13 can be configured to transfer torque between the hub junction 13 and the spring 11. In some embodiments, the wheel junction 15 can be configured to transfer torque between the wheel junction 15 and the spring 11. In some embodiments, both the wheel junction 15 and the hub junction 13 can be configured to transfer torque between the spring 11 and the wheel junction 15 and the hub junction 13.

Junctions

Figure 3:
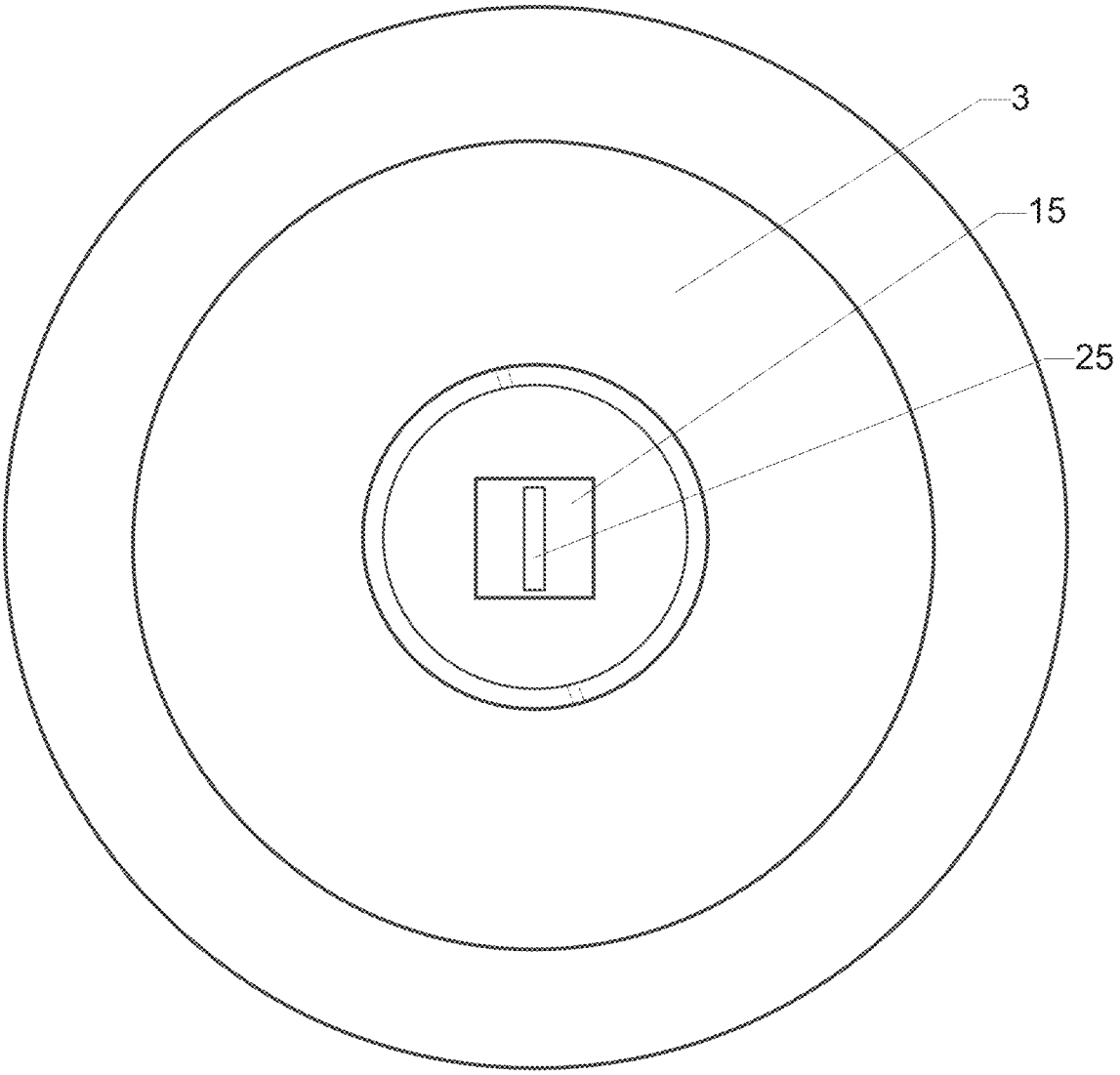
FIG. 3 shows an embodiment of a wheel junction.
Figure 4:
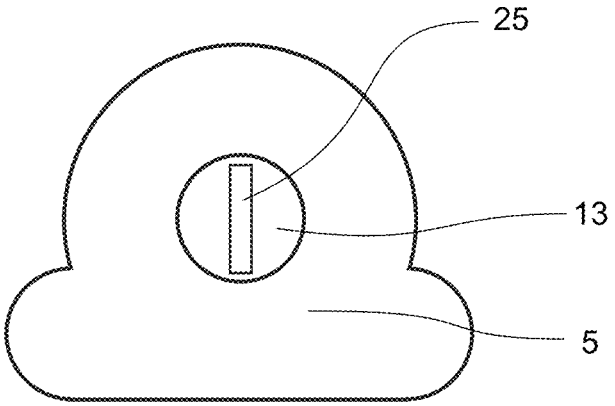
FIG. 4 shows an embodiment of a hub junction.

Junctions, such as wheel junctions and hub junctions are configured to transfer torque between the junction and the spring. In some embodiments, a junction can comprise a relief opening, such as a slot, which receives an end of the spring, such as a hub end or a spring end. FIG. 3 shows an embodiment of a wheel junction having a slot and FIG. 4 shows an embodiment of a hub junction having a slot. The spring end can include one or more extensions extending from the spring, such as a loop, a tab, a pin or another shape or a series of loops, tabs, pins, other shapes and combinations thereof which when inserted into the relief opening can interact with the interior surfaces of the relief opening to transfer forces therebetween such as in the form of a couple. In some embodiments, the relief opening can extend entirely across the face of the junction so as to have open ends at each edge of the junction. In some embodiments, the relief opening can extend across only a portion of the junction so as to have no open ends or only one open end at an edge of the junction.

In some embodiments, the relief opening can comprise two parallel faces extending into the face of the junction. In some embodiments, one or more faces of the relief opening can be curves. In some embodiments, the relief opening can have faces which are planar. In some embodiments, the junction can comprise more than one relief opening, such as where two or more relief opening cross one another or where two or more relief opening do not intersect with one another. In some embodiments, the relief opening can have a shape where the length is substantially the same as the width, such as in the shape of a square, or where the length is longer than the width, such as in the shape of a rectangle. In some embodiments, the relief opening can be in the shape of a triangle or other geometric shape where a spring end would be able to interact with wall to transfer torque. In some embodiments, the relief opening can comprise multiple openings, such as two or more holes and the spring end can comprise extensions which fit into two or more holes so as to transfer torque. In some embodiments, the two or more holes can be in the shape of circles, squares, triangles, ovals or other suitable shape, with one hole having the same or different shape from the other.

In some embodiments, the junction can have one or more extensions, as described above for spring end, and the spring end can include a relief opening as described above for the junctions, where the one or more extensions are slidably received into the relief openings and transfer torque.

In some embodiments, a wheel junction can be a part of the wheel or the wheel junction can be a separate part attached to the wheel. FIG. 3 shows an embodiment of a replaceable wheel junction having a square shape, however different shapes can be used. In some embodiments, the replaceable wheel junction can be made to have different sizes/shapes/configurations/number of holes or slots for use with different spring ends. In some embodiments, a replaceable wheel junction can be dropped into a receptacle in the wheel or it can be a friction fit into a receptacle in the wheel or it can be attached to the wheel by other means as would be understood by those of skill in the art.

In some embodiments, the hub junction can be a part of the hub or the hub junction can be a separate part attached to the hub. In some embodiments, the hub junction can be replaceable having features as discussed for a replaceable wheel junction.

Spring Tension/Movement of the Exercise Device

In some embodiments, as the wheel turns in relation to the body, torsional energy will be stored in the spring 11. Rotating the wheel further results in greater energy being stored in the spring 11.

When the exercise device is placed on a surface and moved in a first direction, the wheel 3 will turn and energy can be stored in the spring 11. The further the exercise device is moved, such as by pushing the exercise device with the wheel(s) turning as the exercise device moves across a surface, more energy can be stored in spring 11. As energy is stored in the spring, a countering force can be present which resists further movement of the exercise device in the first direction. If the pushing force is decreased to below that of the countering force, the exercise device will move backwards counter to the first direction. In some embodiments, the exercise device can also be moved in a second direction, opposite to the first directions and the spring will store energy and apply a countering force in an opposite direction to when the exercise device is moved in the first direction.

Spring

Figure 5:
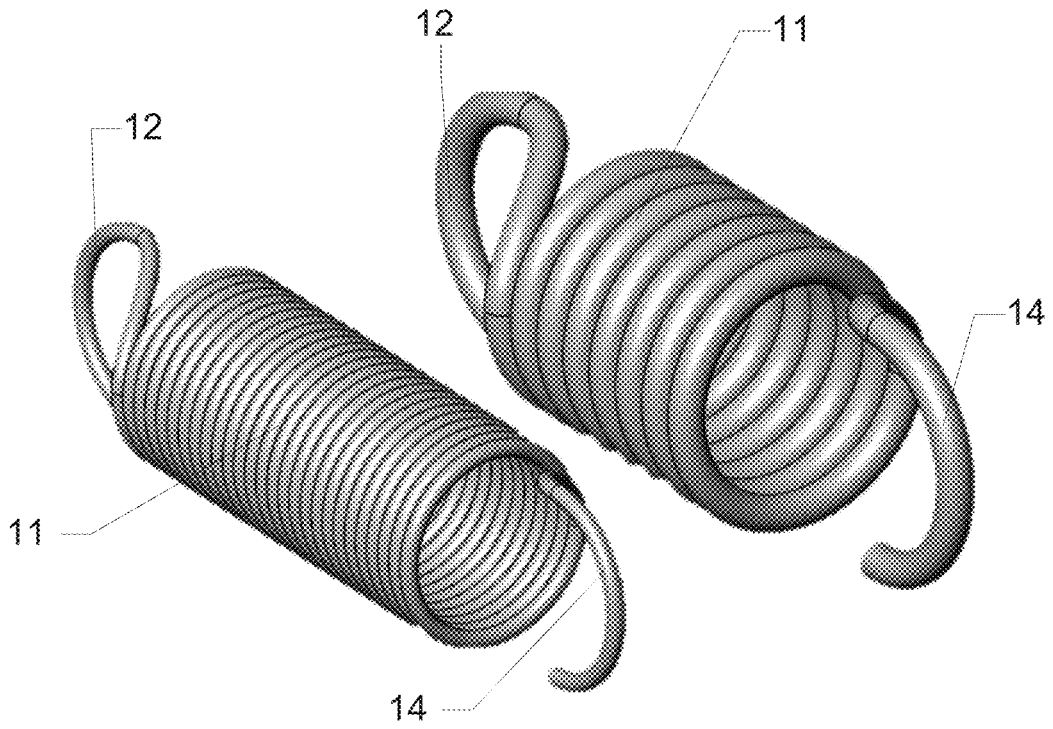
FIG. 5 shows an embodiment of a spring.

In various embodiments, the spring 11 can be a material which is capable of storing torsional energy. In some embodiments, the spring 11 can be a coil spring, such as is shown in FIG. 5. In various embodiments of a coil spring, the coil spring can have different numbers of loops, the loops can be spaced close to one another, such as would be associated with a coil spring that is tightly wound, or the loops can be spaced further apart, such as would be associated with a coil spring that is more loosely wound. In various embodiments, the spring material can be thicker or thinner and of a suitable material so as to provide desirable spring force characteristics and energy storage.

In some embodiments, the spring 11 can have a different shape, such as being in the form of a rod, a sheet or multiple rods, or sheets or combinations thereof.

Spring material can be or comprise any suitable metal, such as steel, stainless steel, steel alloy, bronze, phosphor bronze, titanium, beryllium copper, or other metals and combinations thereof. Spring materials can also be or comprise polymer or elastomers.

In some embodiments, the spring 11 can be installed entirely within the axle 6. In some embodiments, the spring 11 can be located partially within and partially without the axle 6. In some embodiments, the spring 11 can be located such that at least a portion of one or both of the spring ends extend from the axle 6. In some embodiments, the spring 11 can be located entirely within the wheel 3 where the spring 11 does not extend past the inner plane 16 and the outer plane 17 of the wheel 3. In some embodiments, the spring 11 can be located only partially within the wheel 3, where the spring 11 extends only partially outside of the inner plane 16 and/or the outer plane 17 of the wheel 3. In some embodiments, the spring 11 can be located outside of the wheel 3 where the spring 11 is located entirely outside of the inner plane 16 and the outer plane 17 of the wheel 3.

In some embodiments, the spring 11 can be sized such that the clearance between the spring and the axle prevents kinking of the spring when the spring is overwound.

In some embodiments, the spring 11 is sized such that the clearance between the spring and the axle and/or the overall length of the spring 11 relieves stress from the spring by allowing the hub and wheel ends of the spring 11 to move toward one another during an overwound condition, resulting in one of the hub and wheel ends of the spring 11 slipping out of the respective junction.

In some embodiments, such as shown in FIG. 1, the spring 11 can be can be installed or replaced, for example, by removing a spring by removing the screws 18 which attach wheel 3 to the axle 6, removing the wheel 3, and then pulling out the spring 11 from the interior of axle 6; then installing a spring by placing the spring 11 into the interior of axle 6 so as the hub end of the spring 11 aligns with and is slidably received into the hub junction such as into a slot in the hub junction; and then installing the wheel 3 by aligning the wheel junction with the wheel end of the spring 11, slidably receiving the wheel end of the spring 11 into the wheel junction, and installing screws 18 to attach the wheel 3 to axle 6.

Wheels

In some embodiments, the wheel can be rotationally affixed to the axle. In one embodiment, as shown in FIG. 1, screws 18 attach wheel 3 to axle 6. However other types of fastening can also be used, such as bolts, clips, pins, nuts and the like.

In some embodiments, a body 2 can be attached to one wheel through a hub assembly 4 which can store torsional energy, as described herein. In some embodiments, a body 2 can be attached to two wheels 18 through respective hub assemblies 2, each of which can store torsional energy as described herein. In some embodiments, a body 2 can be attached to a first wheel 3 through a hub assembly 4 which can store torsional energy as described herein and to a second wheel through other than a hub assembly 4 which can store torsional energy as described herein. In some embodiments, the exercise device 1 includes only one wheel and the wheel is connected to the body 2 through a hub assembly 4 which can store torsional energy as described herein. In one embodiment, the exercise device includes exactly two wheels 18 and both of the two wheels are connected to the body 2 through respective hub assemblies 2 which can store torsional energy as described herein.

In some embodiments, an exercise device 1 can have more than two wheels, such as four wheels. In some embodiments having more than two wheels, one or more or all of the wheels can be attached to the body 2 through respective hub assemblies 2 which can store torsional energy as described herein. In some embodiments with four wheels, one, two, three or four wheels can be attached to the body 2 through respective hub assemblies 2 which can store torsional energy as described herein.

When a wheel 3 is attached to body 2 other than through a hub assembly 4 that can store torsional energy as described herein, the wheel 3 can be attached by any suitable means such as through a fixed axle, a rotating axle, or otherwise as would be known to one of skill in the art.

In some embodiments, wheels of different sizes and with different surface contacting features (e.g. tread) can be used for example to accommodate different exercises, different sizes of user, different surfaces for the exercise device to move along, and the like.

Body

In some embodiments, a body can extend between two wheels. The body can be sized and configured for an individual using the exercise device to be able to place any portion of a user's anatomy that is desired and in the orientation desired. In some embodiments, the body 2 can be sized and configured for one or two feet, hands, knees, forearms or etc. on the body to use the exercise device. In some embodiments, one or two feet/hands/knees/forearms/etc. can be oriented with the feet/hands/knees/forearms oriented with the direction of movement of the body. In some embodiments, the feet/hands/knees/forearms/etc. can be oriented sideways (e.g. with toe and heel pointing at the wheels 3) or at an angle to the direction of movement of the body 2. In some embodiments, the body can be sized and configured for an individual using the exercise device to be able to place only one foot, hand, knee, forearm or etc. on the body to use the exercise device. In some embodiments, the body 2 can be sized and configured for a user's back or bottom to contact the body 2 during exercise.

Figure 6:
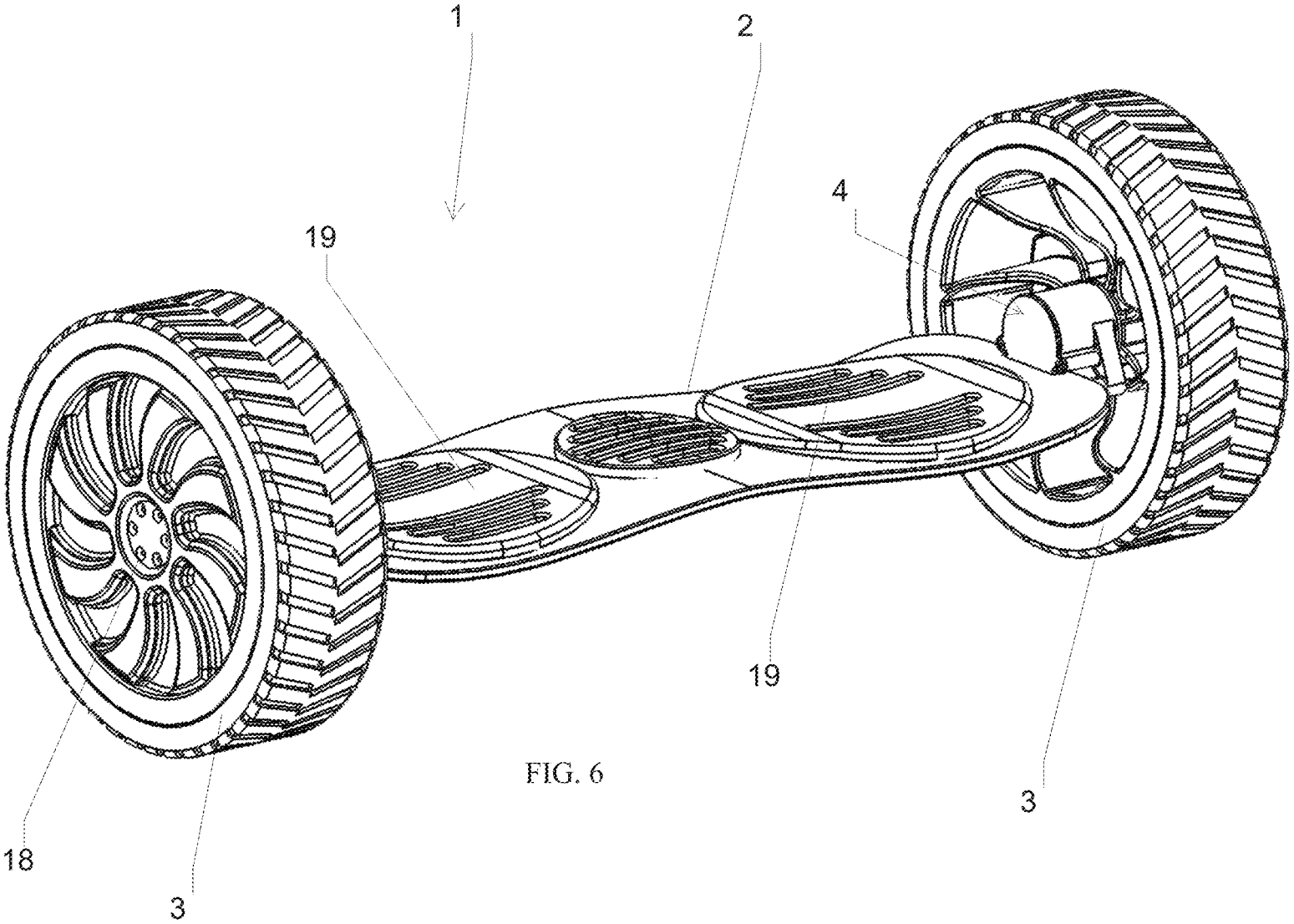
FIG. 6 shown an embodiment of an exercise device.

In some embodiments, the body can include recess(es) or bump(s) or combinations thereof on a surface of the body to interface with feet or hands or forearms or other portions of a user's anatomy and assist in placement of the feet/hands/knees/forearms/etc. at an appropriate location on the body. FIG. 6 shows an embodiment of an exercise device 1 having recesses 19 in the body 2. In some embodiments, the recesses or bumps can be achieved by curving the body 2.

In some embodiments, one or more straps can be positioned on the body to be grasped by an individual while using the exercise device 1 or for the user to place hands/feet/forearms between the strap and the body while using the exercise device 1. (See FIG. 7.)

In some embodiments, padding can be provided on the body.

Secondary Platform

Figure 7:
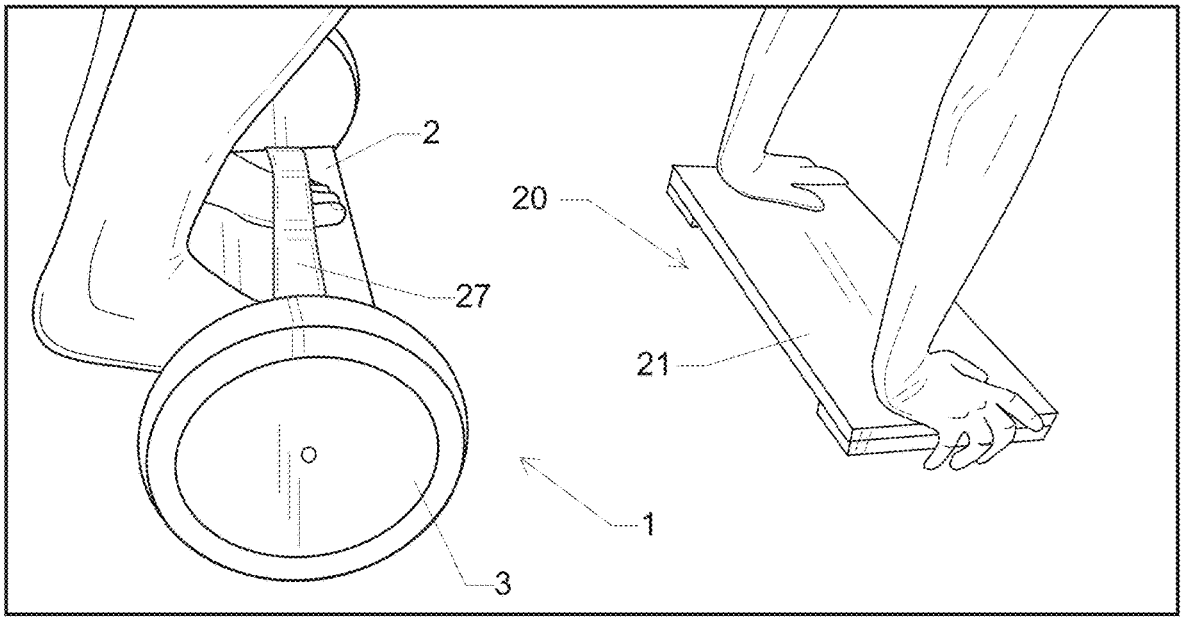
FIG. 7 shows an embodiment of an exercise device having a strap.

In some embodiments, the exercise device can be used with a secondary platform 20 comprising a surface 21 raised off the ground as shown in FIG. 7. In general, the secondary platform 20 can be sized and configures to support one portion of a user's anatomy while the exercise device 1 supports and is moved by another portion of a user's anatomy. In some embodiments, the secondary platform can be sized and configured for placing one's feet thereon while one uses the exercise device with one's hands on the exercise device. In some embodiments, the secondary platform can be sized and configured for placing one's hand(s) on the secondary platform or to grasp the edge(s) of the secondary platform while one uses the exercise device with one's foot/feet on the exercise device. In some embodiments, the secondary platform can be sized and configured to support one foot of a user while the exercise device 1 supports the other foot of the user. In some embodiments, the secondary platform can be used to support one or both feet of a user while the exercise device support one or both hands of a user.

Operation of the Exercise Device

Generally, the exercise device operates by the spring(s) 11 providing a resisting force against rotation of the wheel(s) while the spring(s) 11 store torsional energy during rotation of the wheel(s) 3, and then releasing this stored energy while providing a restoring force during rotation of the wheel(s) 3 in the opposite direction. In various embodiments, the restoring force can be a force that assists the user in the movement of the exercise device 1 or the restoring force can be a force that the user resists during movement of the exercise device 1.

Exercise device 1 can be employed in exercises by a user in many ways. One exemplary embodiment involves the user placing his/her hands on the body 2 with the wheels 18 resting on a surface, the user placing his/her feet on the surface with the user's body bent at the waist, and the user pushing the exercise device 1 away from the feet against spring force in the exercise device 1 and at least partially straightening the user's body. With this movement, the exercise device is moved against a resisting force provided by the spring(s) 11 while torsional energy will be stored in the spring(s) 11 of the exercise device 1. The user can then move exercise device back toward the starting position and toward the user's feet with the spring(s) 11 of the exercise device 1 providing a restoring force which can assist the user in the movement back toward the starting position while releasing energy stored in spring(s) 11. In a variation on this embodiment of a use, the user can place his/her hands on the surface and his/her feet on the body. In further variations on these embodiments, the starting position can be with a more straightened body, and the motion that stores torsional energy into spring 11 can be a movement that bends the body, for example, at the waist.

In another embodiment of an exercise with the exercise device, a user can place one foot on the exercise device and his/her other foot on the surface the exercise device is on or on a secondary platform that is placed on the surface the exercise device is on, and the feet are moved alternately away from and toward each other, with the spring(s) 11 alternately storing torsional energy while providing a resisting force and releasing energy while providing a restoring force.

Further Embodiments

The features discussed in various embodiments above can be combined with the features of various embodiments discussed below. Exercise devices, such as those discussed herein, can include a platform and one or more wheels. In embodiments that comprise two wheels, the wheels can rotate independently of one another or two or more wheels can be in locked rotation with one another. When wheels (or other parts) are in locked rotation with one another, rotation of one wheel can cause rotation of the other wheel and stopping or braking of one wheel can cause the stopping or braking of the other wheel.

Locked rotation can be achieved in some embodiments by using a common axle for two or more wheels, where each of the wheels rotates with the axle, rather than where at least one of the wheels rotates on the axle.

Locked rotation can be achieved in some embodiments by providing a shaft 55 that interacts with each of a first and a second wheel 73, 74 which are rotationally locked thereby. In some embodiments, the shaft 55 is not the axle for one or both of the wheels. In some embodiments, the shaft 55 is physically offset from the axle of one or both wheels. In one embodiment, the first wheel 73 rotationally interacts with a first end of the shaft 55 and the second wheel 74 rotationally interacts with a second end of the shaft 55. The shaft 55 can have a first spur wheel or gear 85 at the first end and optionally a second spur wheel or gear 85' at the second end of the shaft 55, where the first spur wheel or gear 85 rotationally communicates with the first wheel, such as by contacting (directly or indirectly) an outer surface or an inner surface of the first wheel, and the second spur wheel or gear 85' rotationally communicates with the second wheel, such as by contacting (directly or indirectly) an outer or an inner surface of the second wheel. In some embodiments, the first wheel or the second wheel can have a raised inner surface that is smooth, roughened or toothed for rotational communication with the respective first or second spur wheel or gear, such as is shown in FIGS. 8A-8D. In some embodiments, the first and second spur wheel or gears 85, 85' can be affixed to the shaft 55 by any suitable method such as pressing, pinning, threading, adhesive, clips, retaining rings, spiral retaining rings, etc.

The shaft 55 can be a single piece, such as a rod or a hollow rod, or it can be a multi-part shaft. The shaft 55 can be straight or it can have bends, curves or angulations, including those formed by a gear-box or other direction changing or torque converting mechanisms.

In further embodiments, the exercise device 41 can include an energy storage device coupled to one or more wheels through a shaft. One such embodiment of connecting an energy storage device through a shaft 55 is shown in FIGS. 8A-D. In various embodiments, the energy storage system can comprise one or more springs with the energy being stored by loading the spring(s) and energy being released by unloading the spring(s).

Figure 8A:
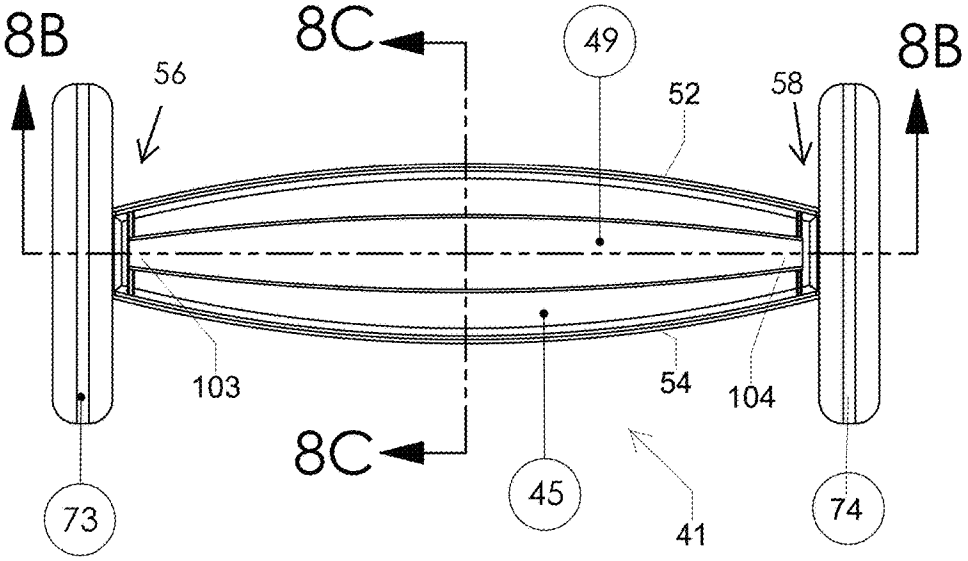
FIGS. 8A-D show an embodiment of an exercise device.
Figure 8B:
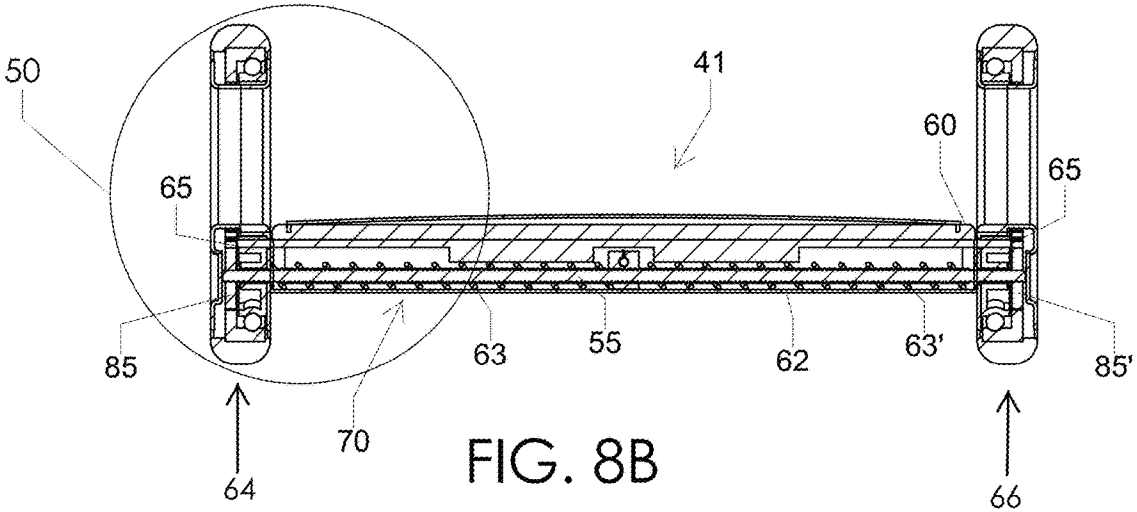

FIG. 8A is a plan view of an embodiment of an exercise device with the exercise device 41 comprising a body 45, the body having a top 60, a bottom 62, a first end 56 located at an edge of the body, a second end 58 located at an opposite edge of the body, and a first side 52 and a second side 54 extending between the first end 56 and second end 58. As shown in FIG. 8B, the exercise device can comprise a first wheel assembly 64 and a second wheel assembly 66 proximate respective first and second ends 56, 58 of the body 45. The first and second wheel assemblies 64, 66 comprise first and second wheels 73, 74, respectively which are configured to roll along a surface during use of the exercise device 41.

Figure 8C:
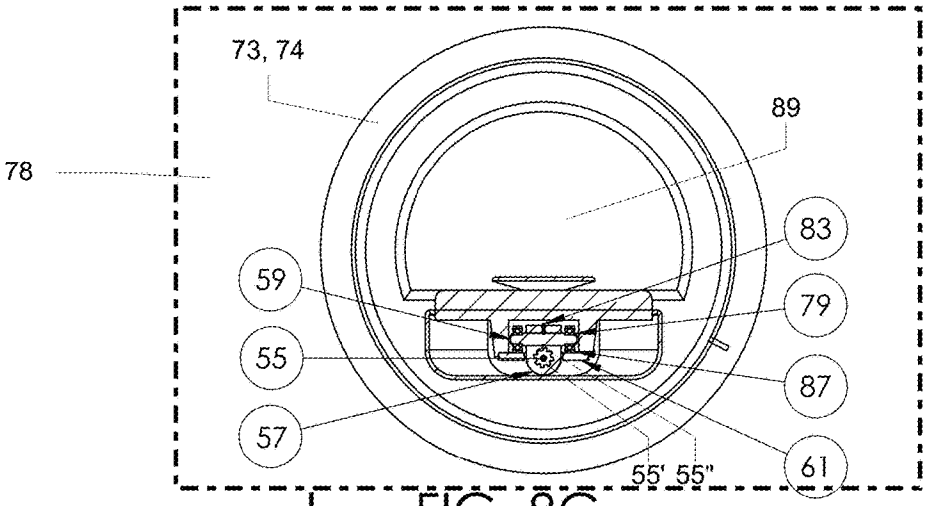
Figure 8D:
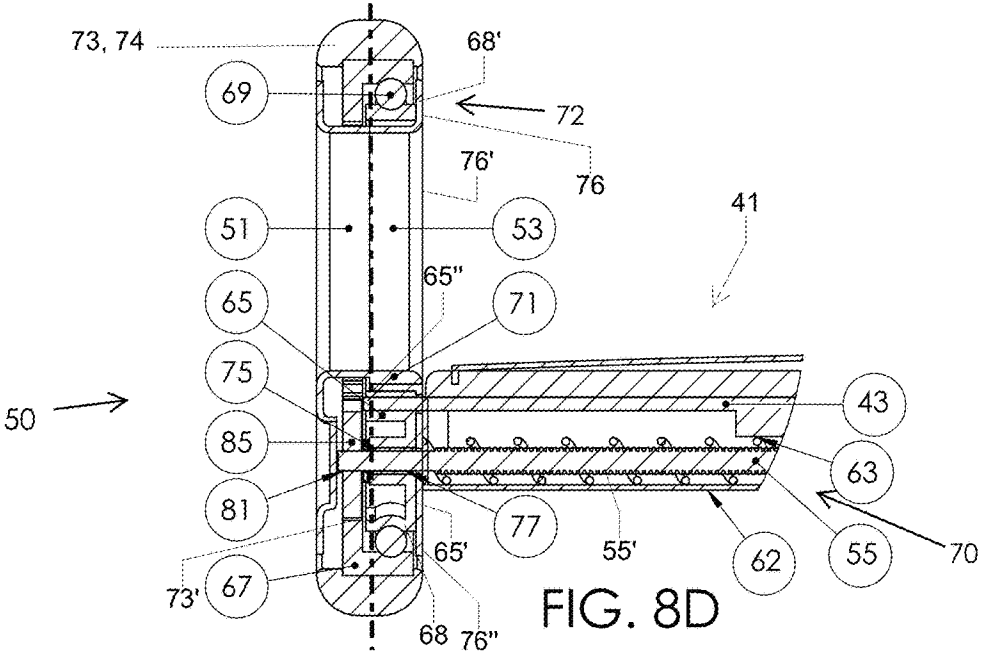

FIGS. 8B and 8C show cross-sectional views of the exercise device of FIG. 8A and show an embodiment of an energy storage device coupled to both of the wheels 73, 74 of the exercise device 41. Although, in some embodiments, the energy storage device can be coupled to only one of the first and second wheels 73, 74. FIG. 8D shows an enlarged view of a portion FIG. 8B. In the embodiment of FIGS. 8B and 8D, the energy storage device 70 stores energy in a spring 63 with the rational energy of the wheel(s) transferred through shaft 55 to compress spring 63 by movement of shuttle 57.

Figure 9A:
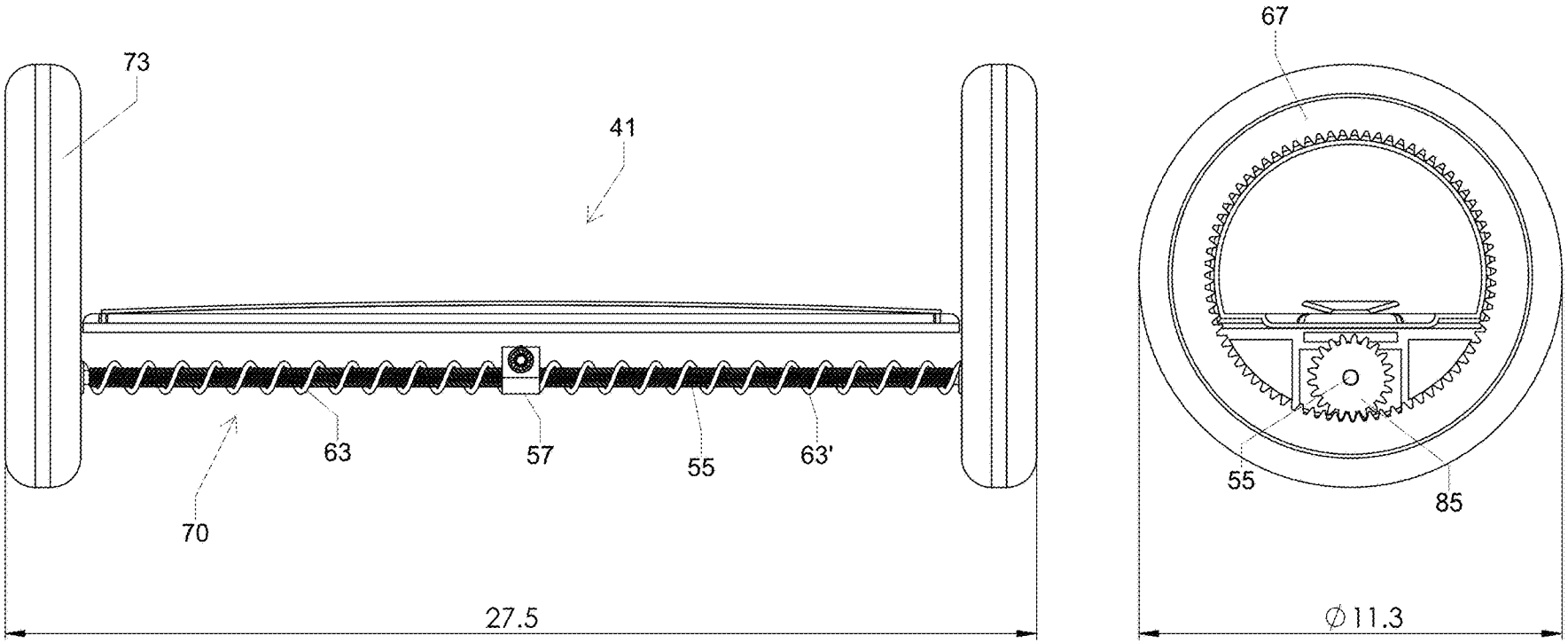
FIGS. 9A-B show an embodiment of an exercise device.
Figure 9B:
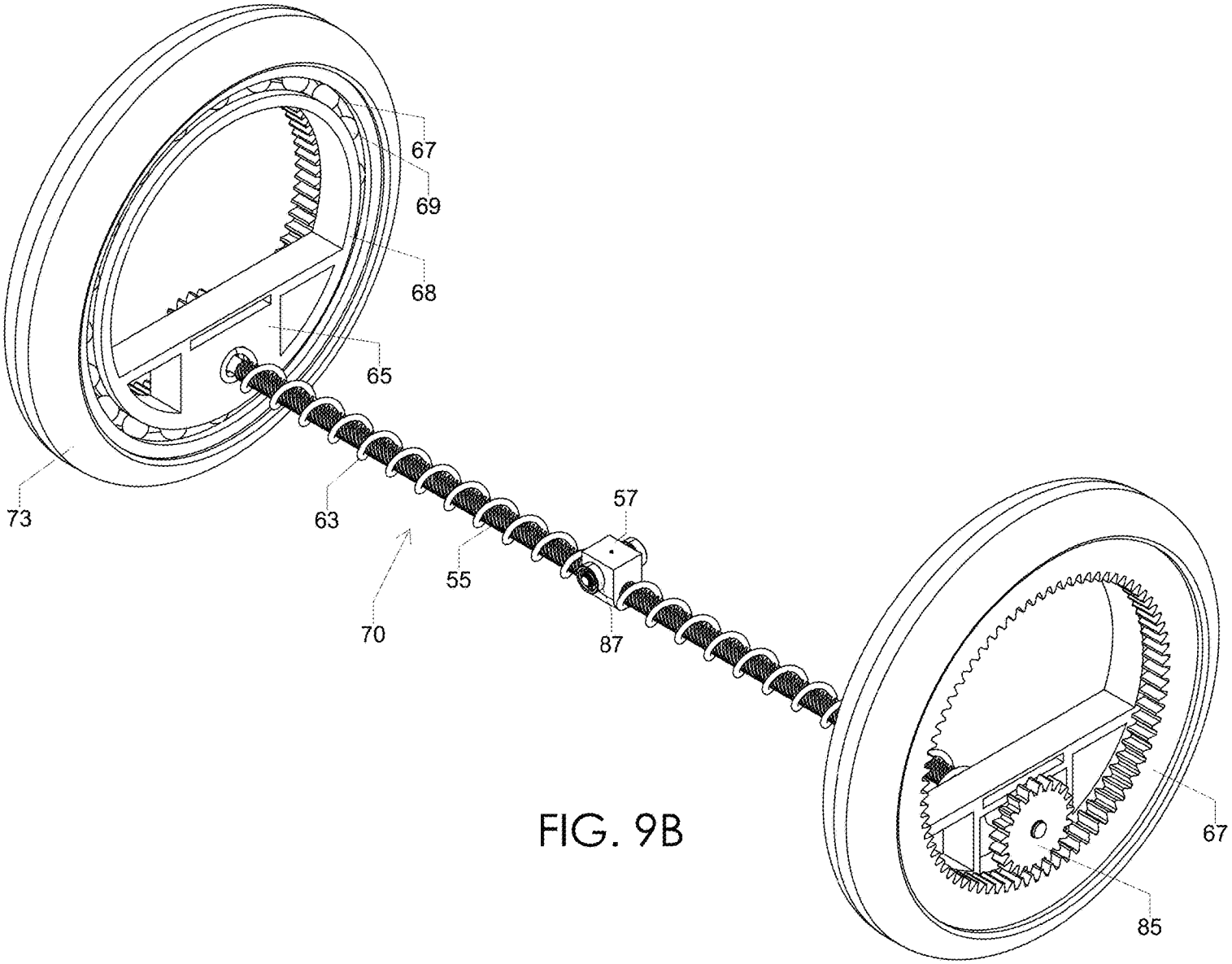

In the embodiment of FIG. 8D, the first and second wheel assemblies 64, 66 respectively comprise a first wheel 73, a second wheel 74 and shaft 55, with the first wheel 73 in rotational communication with the second wheel 74 through the shaft 55. In some embodiments, the shaft is in rotational communication with the first wheel and the second wheel where the first wheel is rotationally locked to the second wheel. In one embodiment of wheels (or other parts) being rotationally locked to one another, rotation of the first wheel 73 causes rotation of the second wheel 74 without substantial slippage the first wheel 73. The rotational locking can be accomplished through friction or through other means, such as mechanical interference (e.g. with splines, gear teeth, non-circular shapes, etc.) The rotation can be in the same direction or a different direction, such as through the use of gears, beveled surfaces, etc. The rotation can also be at the same speed or at a different speed, such as can be accomplished through gearing, pulleys or other speed changing techniques. In some embodiments, the shaft 55 can extend through the body of the device. In some embodiments, such as is shown in FIG. 8D, the first and second wheel assemblies can include shaft support(s) 65 that support the shaft. In some embodiments, the first and second wheel assemblies can include bearing(s) such as sleeve bearing(s) 77 providing a rotating connection between the shaft 55 and shaft support(s) 65. (While a sleeve bearing 77 is shown, any suitable type of bearing can be used such as sleeve bearings, bushings, roller bearings, ball bearings, etc. or no additional bearing at all, with the shaft riding on the support.) As the first wheel 73 rotates in relation to the body 45 of the exercise device, such as when the exercise device 41 is rolled across a surface, such as when using the exercise device 41 for exercise, the wheel rotates the shaft 55, which then causes the shuttle 57 to move toward the first or second wheel 73, 74, compressing the spring 63 by the shuttle. FIGS. 9A and 9B show an additional embodiment of an exercise device with a spring loaded shuttle as an energy storage device.

Figure 12:
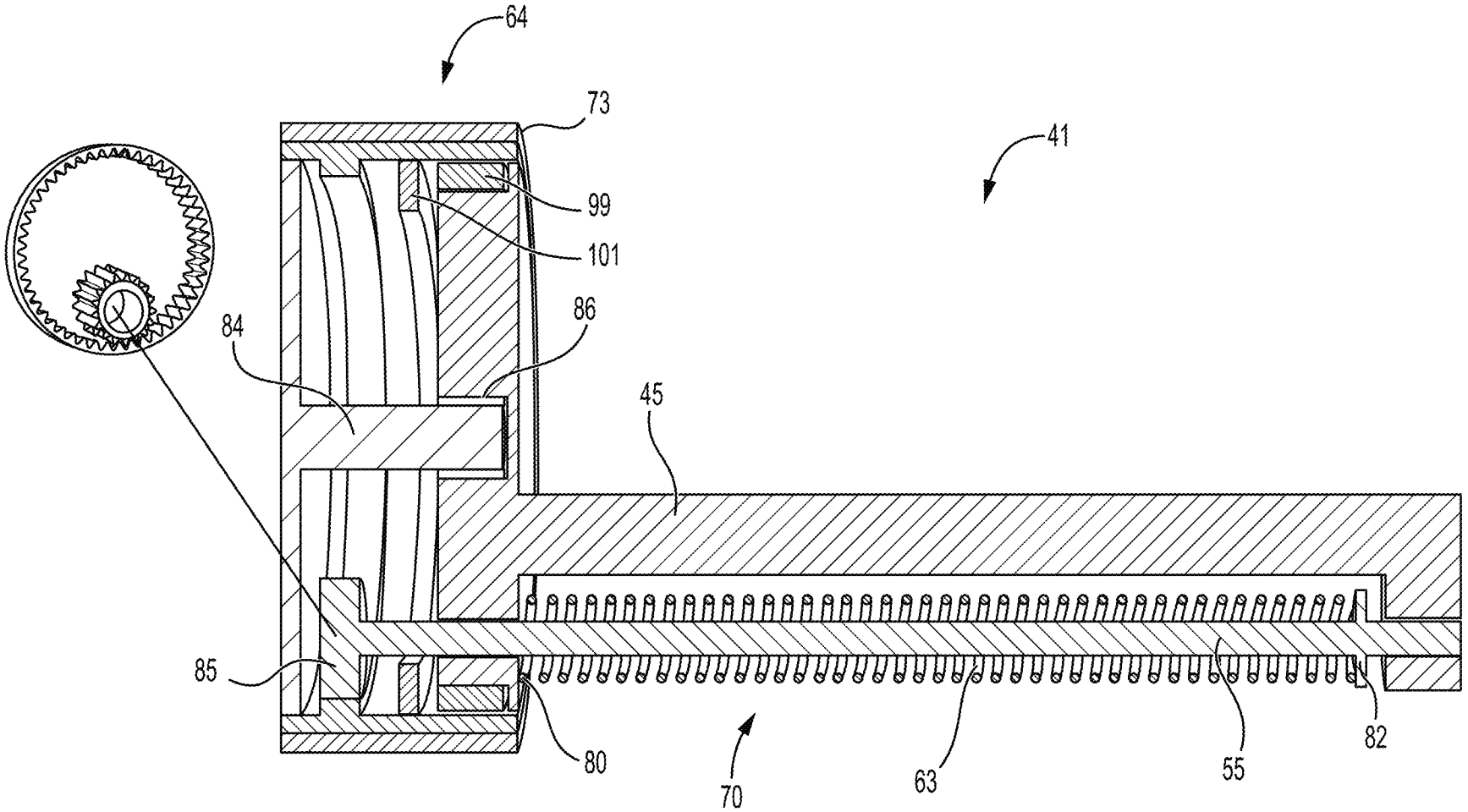
FIG. 12 shows a portion of an embodiment of an exercise device.

In the embodiment of FIG. 12, FIG. 12 shows the source of resistance as a torsional spring located inside or under a deck body, rotational alignment between wheels being maintained with a matching planetary gear set and cross shaft, damping can be achieved with a magnetic damper located inside the hub, or frinction damper, and a low slung body providing stability where the energy storage system is a spring 63 that stores energy through rotational deflection of the spring 63 as torsional energy. In FIG. 12, as the wheel 73 turns, the spur wheel or gear 85 is rotated by the wheel 73. The rotation of the spur rotates the shaft 55 which is fixed to one end of spring 63 while the opposite end of spring 63 is affixed to the body 45 or a stationary part of the wheel assembly 64. As the shaft 55 turns, from movement of the wheel 73 from a rest position, the spring is twisted and stores energy, providing a resisting torque to further movement of the wheel 73 away from the rest position and when the wheel is moved or allowed to move back toward the rest position, the spring 63 provides a restoring force to urge the wheel back to the rest position. While the embodiment of FIG. 12 shows the spring attached to a stationary part of the exercise device 41 at a stationary anchor 80 proximate the wheel 73 and attached to the shaft at a rotating anchor 82 distal the wheel 73, some embodiments can have the rotating anchor 82 proximate the wheel 73 and the stationary anchor 80 distal the wheel 73. In some embodiments, an exercise device can include an energy storage device associated with only one of the wheels of the exercise device, or can include respective energy storage devices associated with more than one wheel of the exercise device. In some embodiments, an energy storage device of FIG. 12 can reach from a first wheel 73 to a second wheel 74 of the exercise device, or can be located between and spaced apart from one or both of the wheels. In some embodiments, an energy storage device can be deflected by movement of both wheels 73, 74 of the exercise device, such as where both wheels are rotationally locked to the shaft 55 and the spring is twisted by the rotation of the shaft 55.

Figure 13:
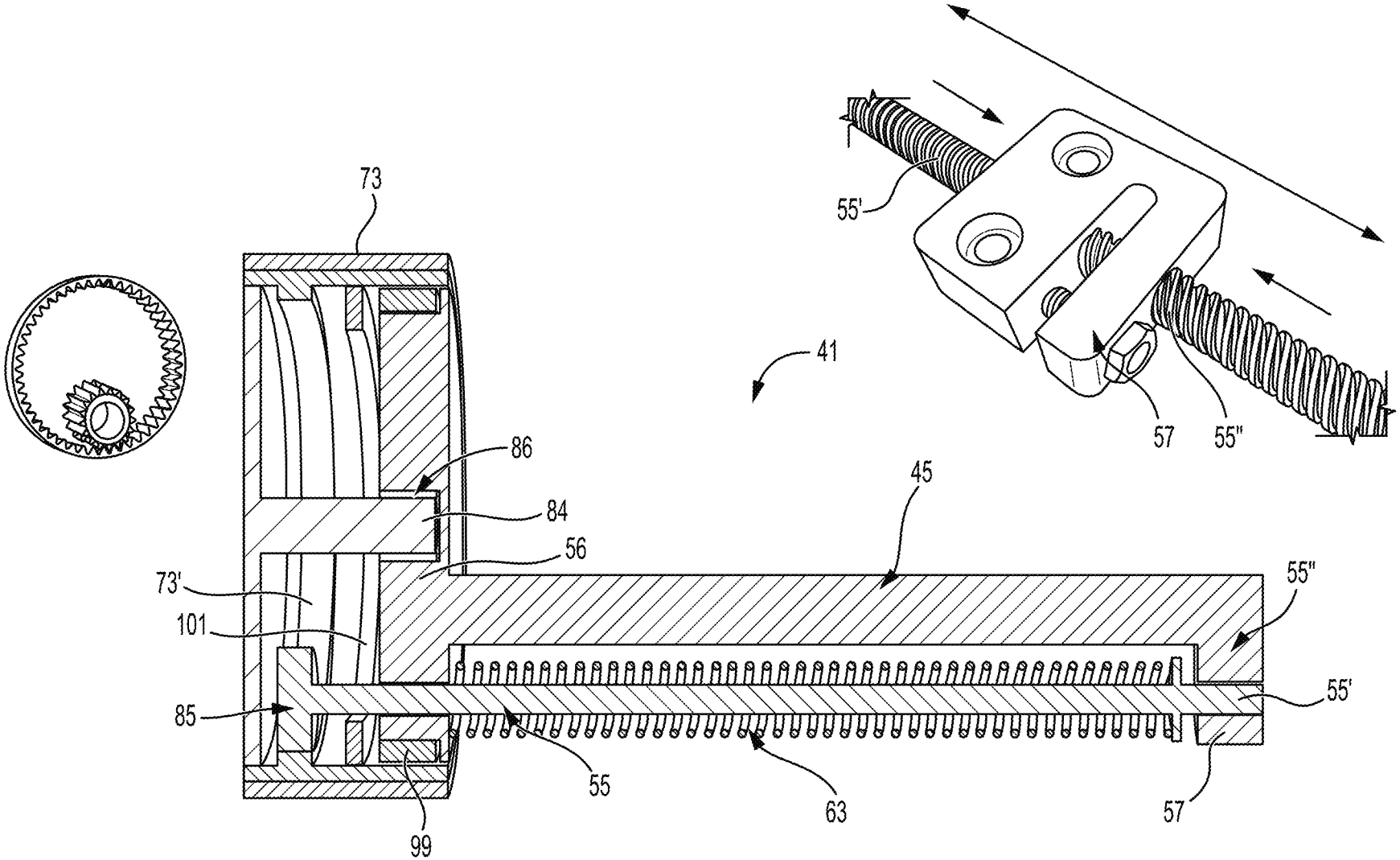
FIG. 13 shows a portion of an embodiment of an exercise device.

FIG. 13 shows an embodiment that is similar to that shown in FIG. 12, but with a spring 63 that is compressed and/or extended with a shuttle 57, lead screw 55' and lead screw 55". FIG. 13 shows the source of resistance as a compression spring located inside or under a deck body, rotational alignment between the wheels being maintained with a matching ring gear set and cross shaft, and a low slung body providing stability. FIG. 13 also shows compression springs that push nut to center from either side and wheels that turn gears to rotate shaft which travels along length of body. In FIG. 13, as the wheel 73 turns, the inner surface 73' of the wheel turns the spur wheel or gear 85, which turns shaft 55 and lead screw 55', which then turns within the lead nut 55" of shuttle 57, causing lead nut (restrained from rotating due to interaction with the underside of body 45) to move along lead screw 55' and shaft 55, compressing or decompressing spring 63 to apply a resistive or restoring torque to the wheel. In some embodiments there can be a plurality of energy storage devices such as that shown in FIG. 13, with some embodiments having a first spring associated with a first wheel 73 and a second spring associated with a second wheel 74. In some embodiments, the first and second springs can be operated by the respective first and second wheels only and in some embodiments, the first and second springs can each be operated by one of or both of the first and second springs.

Figure 14:
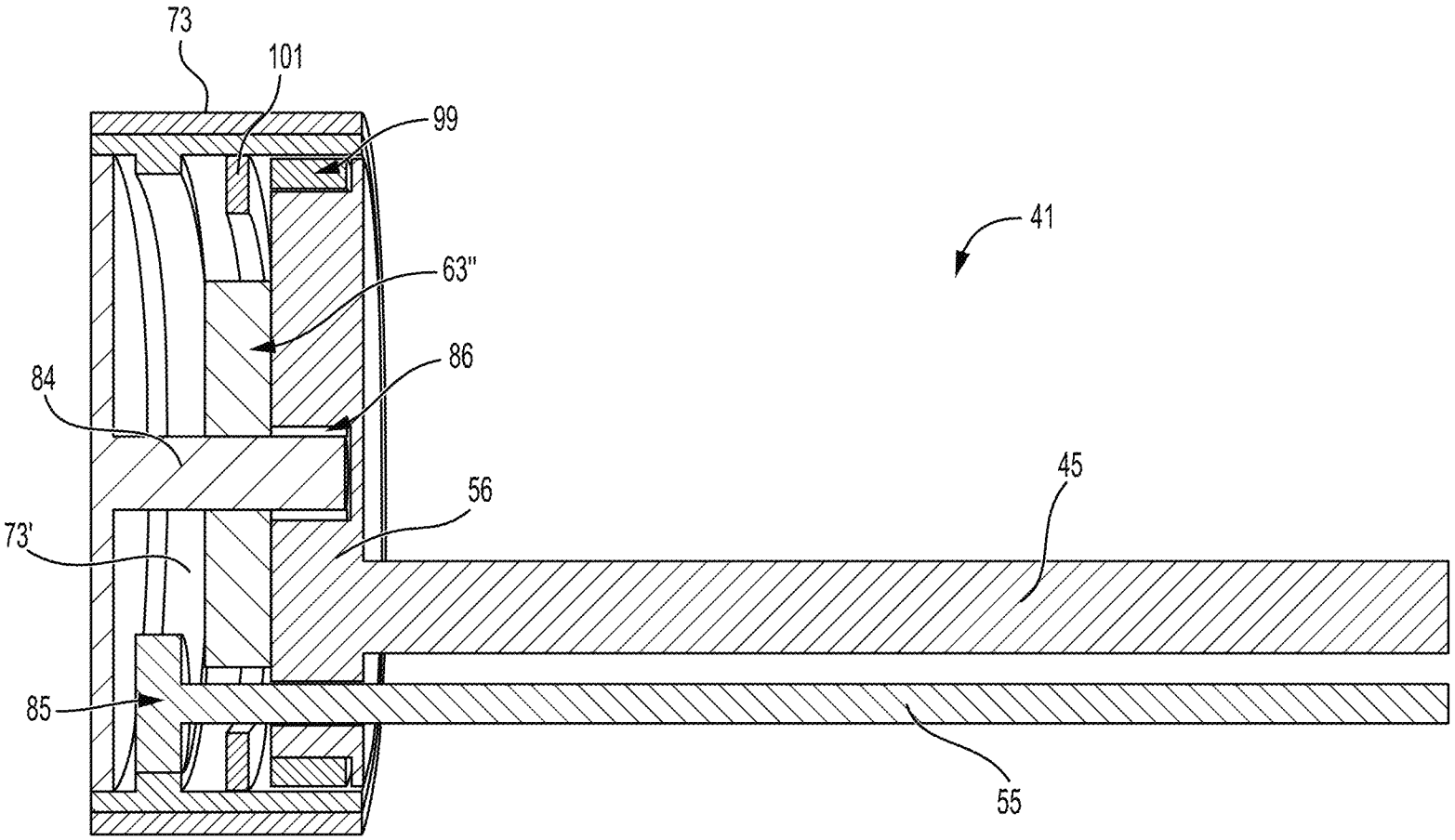
FIG. 14 shows a portion of an embodiment of an exercise device.

FIG. 14 shows an embodiment that is similar to that shown in FIG. 12, but with a clock spring energy storage device. In the embodiment of FIG. 14, FIG. 14 shows the source of resistance as an internal hub clock spring, rotational alignment between the wheels being maintained with a matching planetary gear set and cross shaft, damping can be achieved with a magnetic damper located inside the hub, or a friction damper, and a low slung body providing stability with a clock spring 63" is located within the wheel assembly. FIG. 14 also shows a shaft 55 with a spur wheel or gear 85 interacting with an interior surface 73 ' of the wheel 73 or wheel assembly 64. The shaft 55 can in some embodiments extend to a second wheel assembly (not shown) with a second spur wheel or gear interacting with an interior surface of a second wheel or the second wheel assembly. In some embodiments, the shaft can rotationally lock the first and second wheels to one another. The clock spring is functionally connected to a rotating portion of the exercise device 41, such as the wheel 73, and to a stationary portion of the exercise device 41, such as a non-rotating portion of the wheel assembly 64 or the end 56, 58 of the body 45. In operation, when the wheel rotates, the clock spring is torsionally deflected to load or unload the clock spring 63", which applies a resistive or restoring torque to the wheel. In some embodiments there can be a clock spring energy storage device associated with only one of the wheels, where the clock spring energy storage device is operated by only one or by both wheels (such as through the shaft 55). In some embodiments, there can be a clock spring energy storage device associated with each of the first and second wheels, and the wheels are locked in rotation to one another or not locked in rotation to one another. In some embodiments, more than one type of energy storage device can be present within a single exercise device 41, such as a combination of two or more of compression spring arrangement, clock work spring arrangement, torsion spring arrangement or another type of energy storage device, such as others disclosed herein.

In some embodiments, the shaft, the shuttle, the energy storage device, the lead nut and/or the lead shaft can be located under the body 45 or within the body 45. In some embodiments, a cover can be located under the body 45 to cover the shaft, the shuttle, the energy storage device, the lead nut and/or the lead shaft. In some embodiments, one or more access panels can be located on the body 45, such as on the top, the underside and/or one or more sides of the body 45 to allow access to the shaft, the shuttle, the energy storage device, the lead nut and/or the lead shaft, such as for assembly, replacement, repair, adjustment, cleaning, etc.

Wheel Assembly

Exercise devices discussed herein are frequently described as having two wheels and two wheel assemblies. However, in various embodiments, the exercise device can include only one wheel and wheel assembly, or the exercise device can have two or more wheels and wheel assemblies, such as two, three, four, five, six, seven, eight or more. In embodiments with more than one wheel and wheel assembly, can include two wheels or more wheels that are rotationally locked to one another. In some embodiments, rotationally locking wheels across the width of the exercise device (e.g. a left wheel and a right wheel) can increase the linear stability of the exercise device during operation, if desired. In some embodiments, the wheels will not be rotationally locked, such as to increase the maneuverability and/or movement flexibility of the exercise device. In some embodiments one pair of wheels or two pairs of wheels can be rotationally locked. In some embodiments, more than two pairs of wheel can be rotationally locked. In some embodiments, three or four or more wheels can be rotationally locked to one another.

Each of the first and second wheels 73, 74 can be supported by one or more bearings 72 to allow the wheel to rotate in the wheel assembly. The centerline of each wheel 73, 74 lies within a respective wheel plane 78. Each of the bearings can be connected to the respective wheel assembly 64, 66 or the body 45 of the exercise device 41 through, for example, a shaft support 65. In some embodiments, an axle 84 can be functionally positioned between the body 45 of the exercise device 41 and the wheel 73, 74. In some embodiments, an axle 84 can rotate with the wheel 73, 74, such as is shown in FIG. 12 where the axle is connected to the body 45 through a bearing 86 (a sleeve bearing is shown, but other types of bearings can also be used, such as a bushing, a roller bearing or a ball bearing), and the axle is connected to the wheel 73 through a flange. In some embodiments, such as is shown in FIG. 8D, a shaft support 65 can serve as an axle by acting as an interface between the inner race 68 and the body 45 of the exercise device 41.

A shaft support can be or comprise a rigid material such as, for example, metal, plastic, ceramic, etc. In some embodiments, the shaft 55 and/or the shaft support(s) 65 can at least partially support the body 45 of the exercise device 41. In some embodiments, the shaft 55 and/or the shaft support(s) 65 can fully support the body 45 of the exercise device 41. In some embodiments, the shaft 55 can rotate in relation to the body of the device. In some embodiments, such as is shown in FIG. 8B, the shaft 55 can extend through first and second shaft supports 65.

In some embodiments, such as is shown in FIGS. 8B and 8D, a wheel assembly 64, 64 can include a wheel bearing 72 that supports the wheel 73, 74 in the wheel assembly to allow rotation of the wheel 73, 74 within the wheel assembly. (In the discussion provided herein, various features, elements and capabilities which can be a part of the wheels and wheel assemblies will be discussed, and the first wheel, or wheel assembly, can be the same or different from the second wheel, or wheel assembly.) Any suitable bearing can be used, such as bushing, roller bearing, ball bearing or sleeve bearing, etc. As shown in FIG. 8D, a ball bearing 72 is shown which comprises balls 69 located between an inner race 68 and an outer race 67. The embodiment of FIG. 8D shows shaft 55 passing through the inner race 68, but in other embodiments, the shaft 55 can pass within the bore of the inner race 68. In some embodiments, the shaft 55 does not pass within or through the inner race 68.

In some embodiments, such as is shown in FIG. 8D, a wheel assembly 64, 66 can include an inner portion 76 covering a side surface 68' of the inner race. In some embodiments, the inner portion 76 of the wheel assembly can comprise an upper inner portion 76' situated above a lower inner portion 76", for example, during operation. In some embodiments, the upper inner portion 76' of the wheel 73 can cover the upper inner surface of the inner race 68. In some embodiments, such as is shown in FIG. 8D, the lower inner portion of the wheel 73 can cover a side surface 65' and an upper surface 65" of the first shaft support 65. In some embodiments, the upper surface 65" of a shaft support 65 can be a surface facing toward an upward direction, for example, facing away from a floor or other surface the exercise device moves across during operation. In some embodiments, the upper surface 65" of the shaft support 65 can be a planar surface. In some embodiments, the inner portion 76 of the first wheel can be or comprise plastic, metal, elastomer, wood, ceramic or other material that can act as a portion of a cover for the area of the exercise device 41. In some embodiments, the inner portion 76 of the wheel can be referred to as a hubcap. In some embodiments, the hubcap can include an inner cap 53 and an outer cap 51. In some embodiments, the inner cap 53 can be situated closer to the body 45 of the exercise device 41 relative to the outer cap 51.

In some embodiments, the exercise device 41 can include a bearing such as a thrust bearing 75 providing a sliding connection between the spur wheel 85 and the shaft support 65, such as is shown in FIG. 8D.

In some embodiments, the hubcap 76 can be a single unitary piece that serves as or includes the inner and outer caps 53, 51. In some embodiments, only an inner cap 53 or only an outer cap 51 can be present. In some embodiments, the inner cap 53 or the outer cap 51 can comprise a plurality of pieces that when assembled in the exercise device forms the inner cap 53 or the outer cap 51 or both.

In some embodiments, the wheel assembly 64 can include an opening 89 into which a portion of a user's body (e.g., a user's hand or foot or a portion of a user's hand or foot or other body part) can be placed or can pass through. FIGS. 11A-D shows an embodiment of an exercise device 41 with such openings. In some embodiments, a portion of the edge of the opening 89 can serve as a grip or gripping surface or handle or as a supporting surface of the body part placed within the opening such as for operation of the exercise device 41. In some embodiments, the inner portion of the wheel assembly 64 can be rotationally affixed to the body of the device so that during operation, the inner portion of the wheel assembly 64 can move and rotate with the body 45 of the exercise device 41 while allowing an outer portion (or wheel 73) of the wheel assembly to rotate in relation to the body 45 of the exercise device 41.

In operation, the opening 89 can be used in the operation of the exercise device 41. In some embodiments, the handles or grips 71 can assist the user in the movement of the exercise device 41. In some embodiments, the handles or grips 71 and/or the body of the device can be positioned below the axis of rotation of one or both of the first and second wheels 73, 74 to improve rotational stability of the body 45 during operation of the exercise device 41. By positioning the handles or grips and/or the body of the device below the axis of rotation of the first and second wheels, without wishing to be limited by theory, it is believed that greater rotational stability of the body (and/or the handles or grips 71) is achieved due to the reduction in potential downward movement of the end 56 of the body 45 during operation of the exercise device 41 as compared to when the handles or grips and/or body of the exercise device were positioned higher in the exercise device.

Figure 15A:
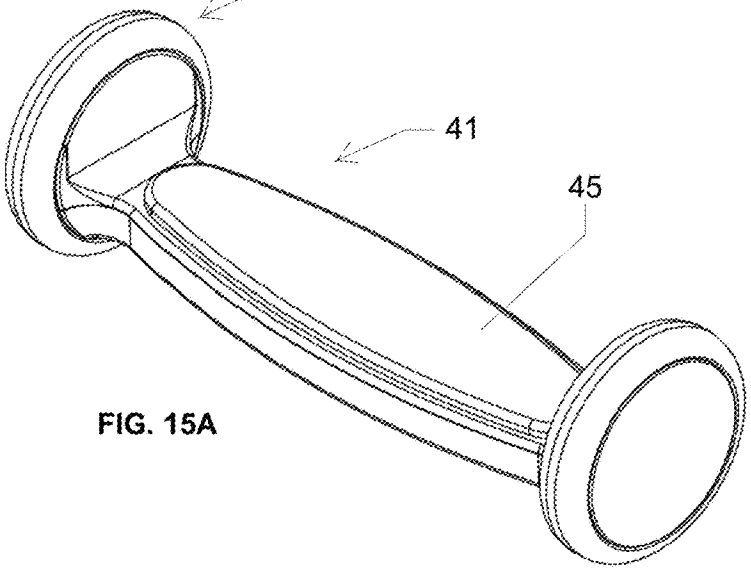
FIGS. 15A-D show an embodiment of an exercise device.
Figure 15D:
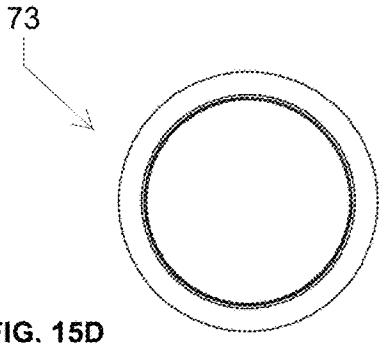
Figure 15B:
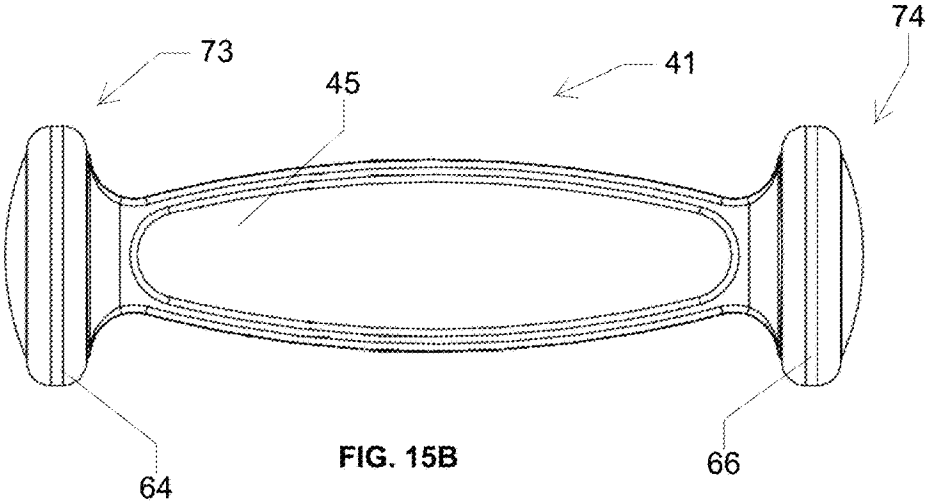
Figure 15C:
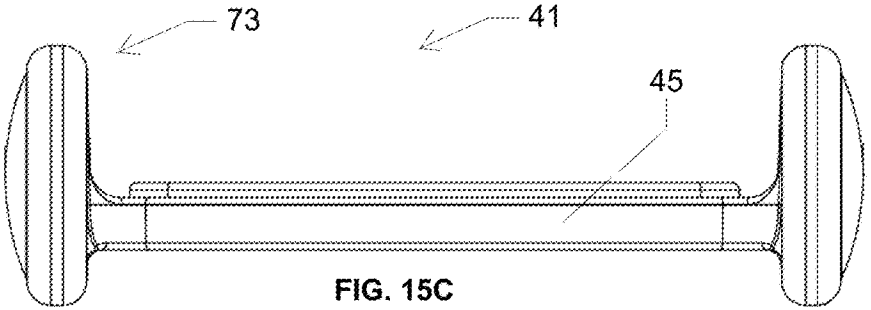
Figure 16B:
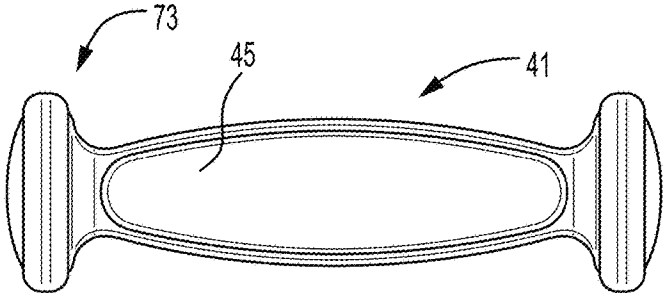
FIGS. 16A-E show an embodiment of an exercise device.
Figure 16C:
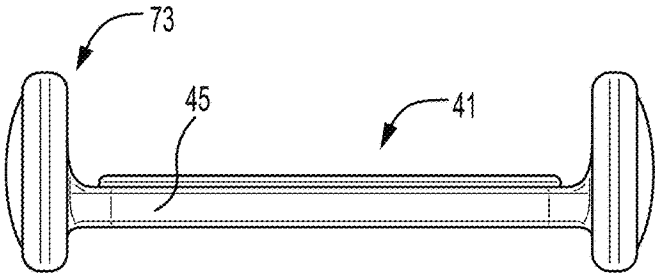
Figure 16D:
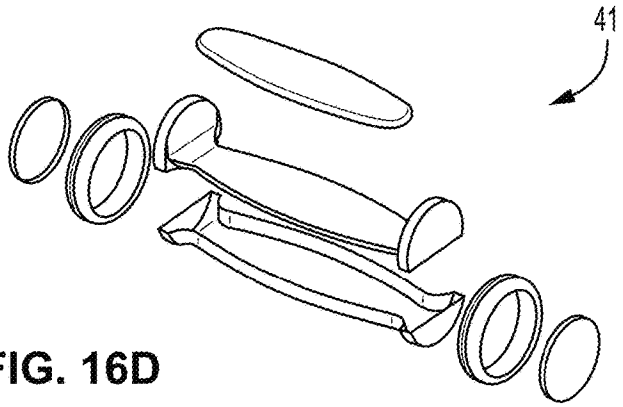
Figure 16A:
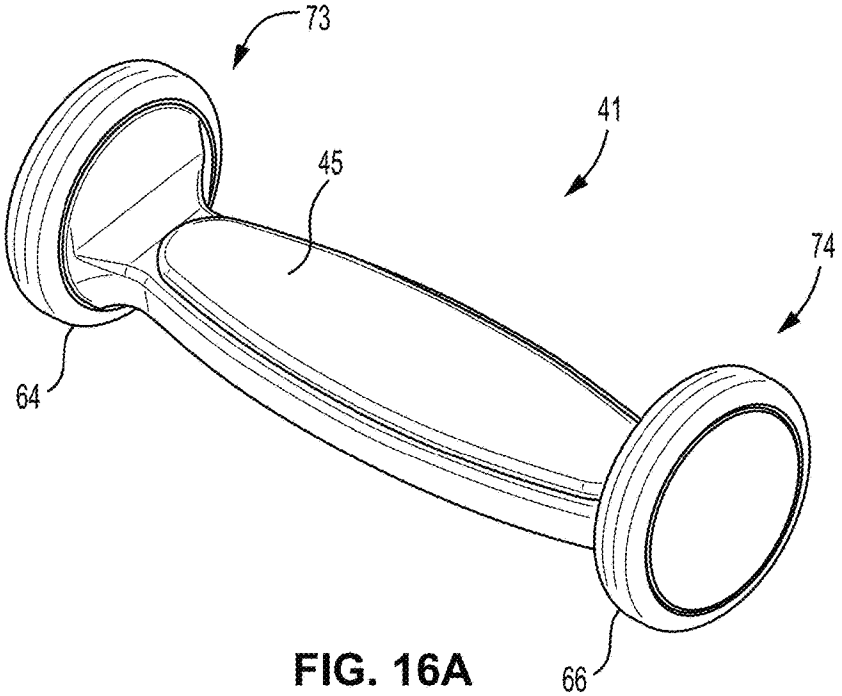
Figure 16E:
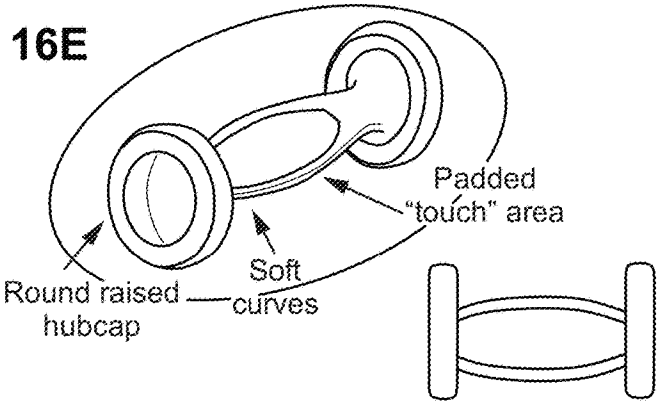
Figure 17B:
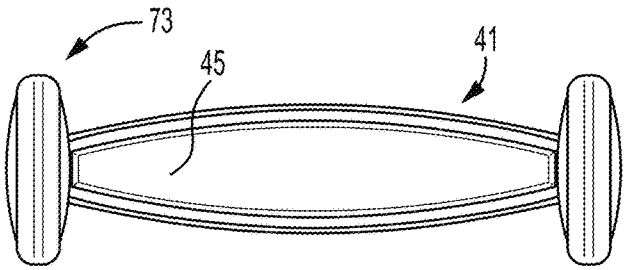
FIGS. 17A-E show an embodiment of an exercise device.
Figure 17C:
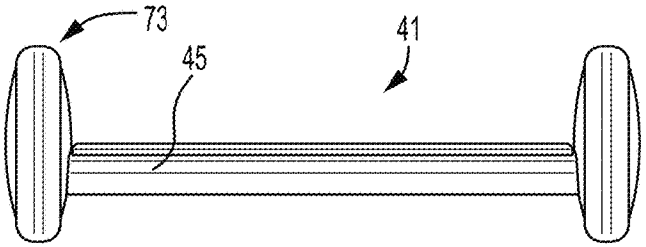
Figure 17D:
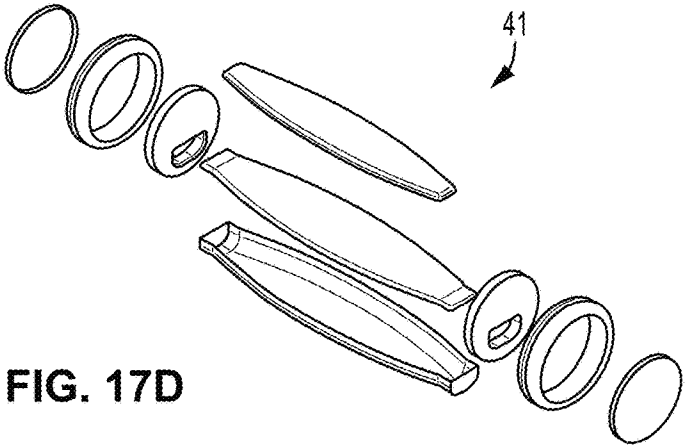
Figure 17A:
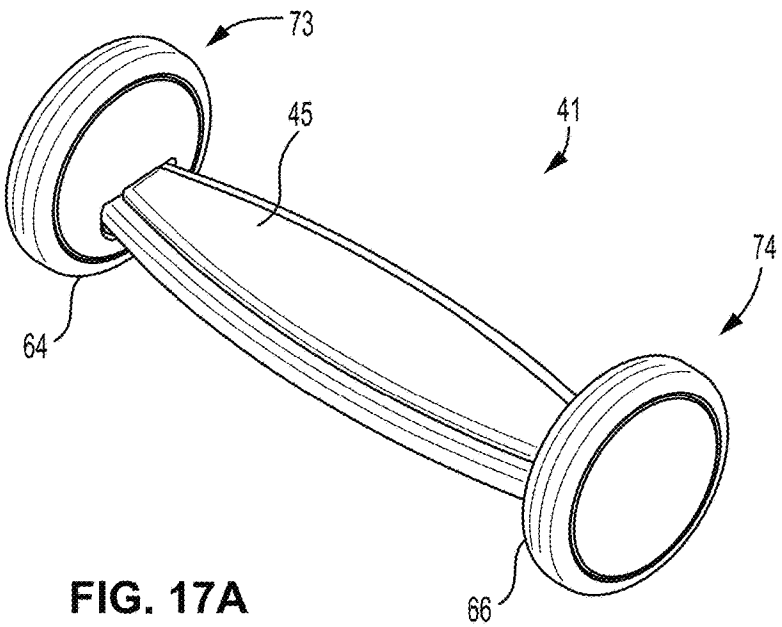
Figure 17E:
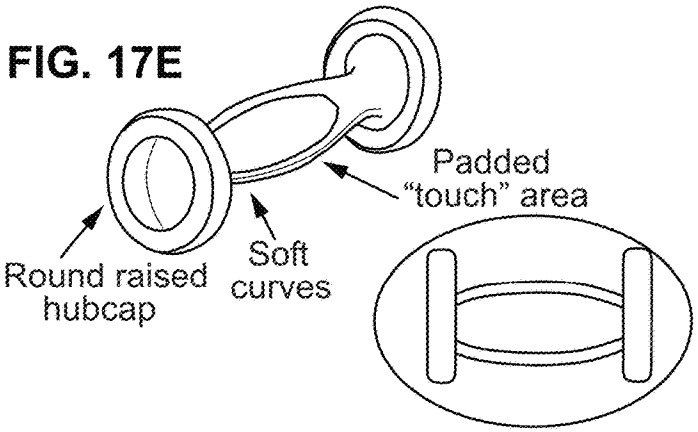
Figure 18B:
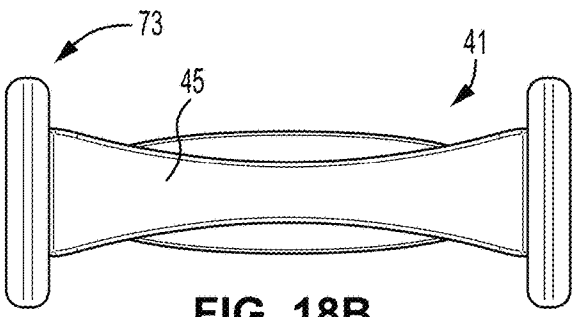
FIGS. 18A-F show an embodiment of an exercise device.
Figure 18C:
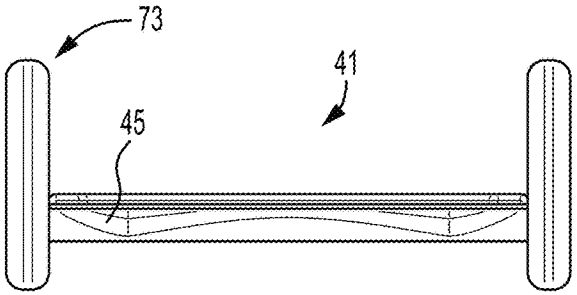
Figure 18E:
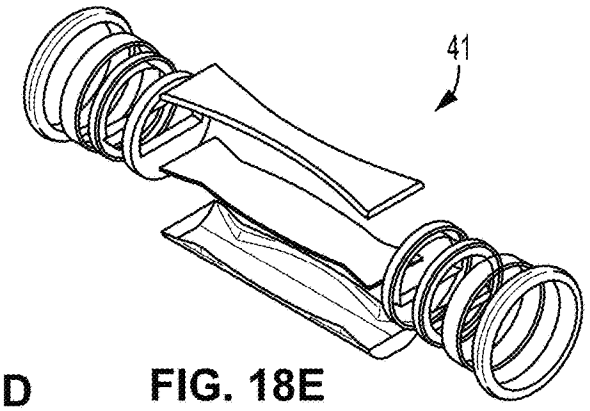
Figure 18A:
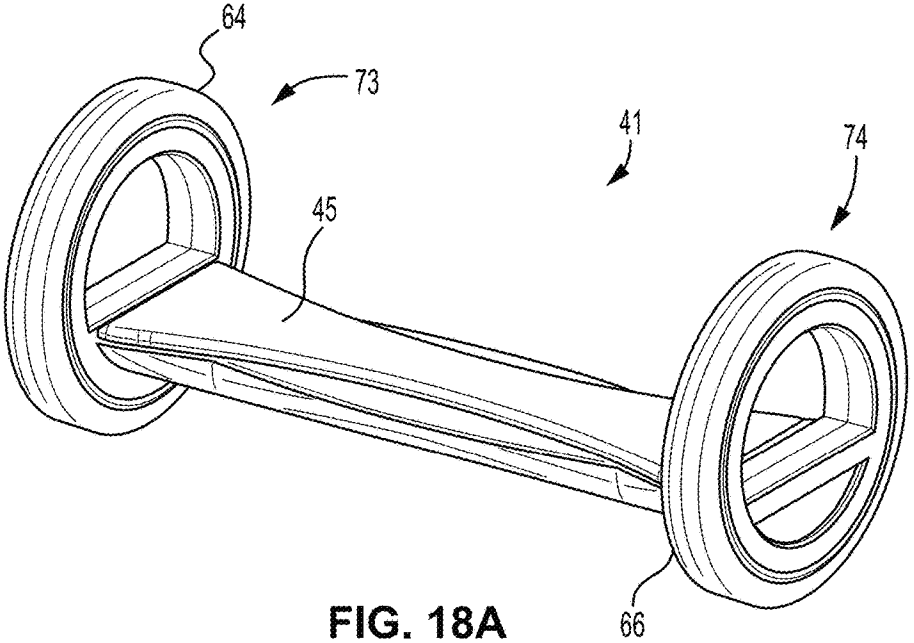
Figure 18D:
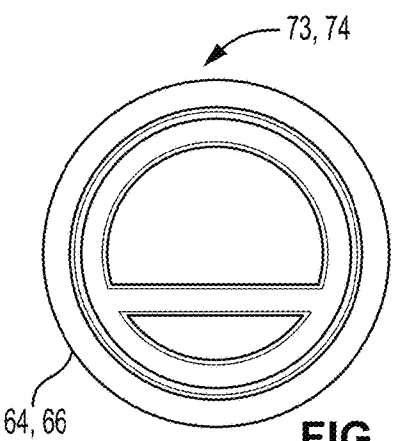
Figure 18F:
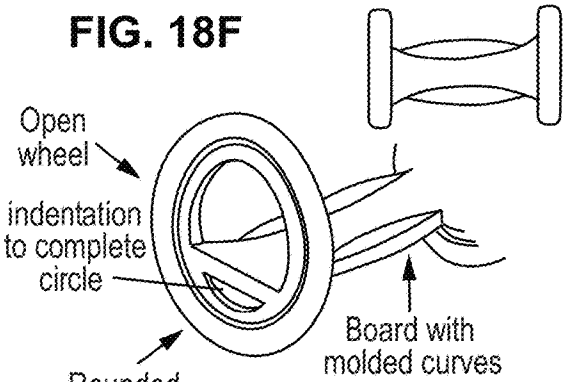

In some embodiments, the wheel assembly 64 can be made to not include the opening 89, such as by providing a cover or other panel or portion of the end of the body that bridges the space within the wheel. Such a configuration is shown for example in FIGS. 15D and 16A.

In some embodiments, a portion, such as the inner portion of the wheel assembly 64, can be rotationally affixed to the body 45 by a board support 43 extending from within the inner portion 76 of the wheel assembly 64 to within the body 45 of the exercise device 41, while allowing the wheel 73 to rotate.

In some embodiments, the wheel 73 can be or comprise any material that can provide sufficient traction between the wheel and the surface the wheel rides upon, such as an elastomer, a plastic, a metal or other suitable material that provides traction and acceptable durability and acceptable sensory characteristics (sound, feel, smoothness, etc.)

In some embodiments, the inner race 68 and the outer race 67 can be coaxial. In some embodiments, the inner race 68, the outer race 67, and the wheel 73 can be coaxial.

In some embodiments, such as is shown in FIGS. 8C and 8D, the wheel assembly 64 can further include a spur wheel 85 in rotational communication with a rotating surface of the wheel assembly 64, such as a surface or an inner surface 73' of the wheel 73, to rotate as the wheel 73 rotates or a surface of another rotating portion of the wheel assembly, such as, for example, the outer race or a portion in contact (directly or indirectly) with the outer race.

In some embodiments, the spur wheel 85 can engage the rotating surface 73' of the wheel 73 with a frictional contact, such as one smooth or substantially smooth wheel rolling along a surface, with sufficient friction being present to prevent undue slippage. In some embodiments, the frictional contact can allow for some slippage, for example to allow turning the exercise device 41 or for other reasons, and the slippage of the first wheel can be the same or different from the second wheel. In some embodiments, the spur wheel 85 can engage the rotating surface 73' of the wheel 73 with a mechanical interaction, such as where the spur wheel is a spur gear and the rotating surface 73' of the wheel 73 is a geared surface that gearingly interacts with the spur gear.

In some embodiments, such as is shown in FIG. 8D, the shaft 55 can extend through the spur wheel 85. In some embodiments, the shaft 55 can be fastened to the spur wheel 85 by any suitable method that can hold the spur wheel 85 on the shaft 55 and prevent undesirable relative rotation of the spur wheel 85 and the shaft 55, such as by threading, press fit, adhesive, pinning, set screw, retaining ring, lock ring, clip, splining, etc., including combinations thereof. Suitable retaining rings can include spiral retaining rings.

Shuttle and Shaft

In some embodiments, such as that shown in FIG. 8C, the shaft 55 can comprise a lead screw 55', and the shuttle 57 can comprise a lead nut 55" interfacing with the lead screw 55'. In FIG. 8C, as the wheels 73, 74 turn, such as by moving the exercise device 41 across a surface, the shaft 55 and lead screw 55' turn. The shuttle 57 and the lead nut 55" can be prevented from rotating due to interference from the underside of the body 45 or due to interference from tracking devices affixed to the underside of the body or affixed to the wheel assembl(ies), and move along the lead screw 55' and shaft 55 toward the first wheel assembly 64 or the second wheel assembly 66, loading first spring 63 and/or second spring 63'. In some embodiments, there can be protrusions extending from the body 45 or one or more recesses in the body 45 that assist in preventing rotation of the shuttle 57. In some embodiments, such as that shown in FIG. 8C, the exercise device 41 can comprise a shuttle track 61 extending along a direction generally parallel to the shaft 55, the shuttle track 61 slidably interacting with the shuttle 57 and preventing rotation of the shuttle 57 during operation. The exercise device 41 can comprise a shuttle roller shaft 59 extending through the shuttle and affixed to the shuttle 57 by way of, for example, a pin such as spring pin 83 (or by any other suitable means.) In some embodiments, the spring pin 83 can prevent the shuttle roller shaft 59 from abutting a protrusion extending from the body 45 or from the shuttle track 61. The exercise device can comprise bearings such as roller bearings 87 on the shuttle roller shaft 59 and providing sliding contact between the shuttle roller shaft 59 and the shuttle track 61. In some embodiments the roller bearings 87 can be affixed to the shutter roller shaft 59 by retaining rings 79 (or by other suitable methods) disposed one or both ends of the shuttle roller shaft 59. In some embodiments, the first and/or second spring 63, 63' can be affixed at one end to the shuttle and/or at the second end to, for example, the body 45 or the wheel assembly 64, movement of the shuttle away from the end of one spring will load the spring by extending the spring, while loading the other spring by compression. (If only one spring is present, the spring will extend or compress depending upon the direction of travel of the shuttle 57.) If the spring is not affixed at both ends, then movement away from the spring will not result in loading of the spring by extension, but will result in loading of the other spring, if present, by compression. If the first end of the spring is not affixed to the shuttle or the second end of the spring is not affixed, for example to the body 45 or the wheel assembly, movement of the shuttle away from the second end of the spring will not load the spring, but movement of the shuttle away from the second end of the spring will load the other spring by compression. The loading of the first and/or the second spring 63, 63' then creates a torque at the first and second wheels 73, 74 resisting the movement of the exercise device when the exercise device is moved away from a rest position (or assisting movement of the exercise device when the exercise device is moved toward the rest position.) When the force applied to the exercise device by a user is reduced sufficiently, the restoring torque applied to the wheels 73, 74 by the first and second spring 63, 63' allows for the first and second wheels 73, 74 to turn, such as by moving the exercise device 41 across a surface back to the original position.

The thread of the lead screw and lead nut can be of any suitable type, such as square, triangular, trapezoidal, ACME, buttress, round, etc.

In some embodiments, the lead screw and the shaft can be separate parts. In some such embodiments, the lead screw can be turned by a mechanism that is turned by the shaft or a rotating part of the wheel assembly.

Springs

In various embodiments, one, two or more springs can be used to store energy. In some embodiments, such as is shown in FIG. 8B, a spring 63, 63' can be positioned between an end 56, 58 of the body 45 and the shuttle 57 or lead nut 55". In some embodiments, a first spring 63 can be positioned between the first end 56 of the body 45 and the shuttle 57 or lead nut 55" and a second spring 63' can be positioned between the second end 58 of the body 45 and the shuttle 57 or lead nut 55". In some embodiments, two or more springs can be located on the same side of the shuttle 57 or lead nut 55", with zero, one or more than one springs on the other side of the shuttle 57 or lead nut 55". In some embodiments, the number of springs on one side of the shuttle or lead nut can be the same or different from the number on the other side of the shuttle or lead nut. In some embodiments, the amount of energy stored in spring(s) on one side of the shuttle or lead nut can be the same or different from the amount of energy stored in spring(s) on the other side of the shuttle or lead nut. In some embodiments, the spring can be concentric with the shaft or lead screw. In some embodiments, the spring can be coaxial with the shaft and/or the lead screw. In some embodiments, the spring is not coaxial with the lead screw. In some embodiments, the spring is not concentric with the lead screw. In some embodiments, the spring can be wound around the shaft.

Springs that can be utilized for energy storage in the exercise device can be of any type suitable for being deflected by a force and can include coil springs, torsion springs, clock springs, bands, bars, levers, tension, compression, flat, serpentine cantilever, helical, leaf, volute, V, etc. The spring can be made from any suitable material that can deflect under force and at least partially return to its original shape when the force is removed. Suitable materials include metals, plastics, elastomers, etc.

Asymetric Load and Preload

In some embodiments, energy device(s) can provide different resistive forces (and restorative forces) for rotation of the wheel(s) in a first direction as compared to a second direction. Such a configuration can provide an exercise device that provides two levels of resistive force difficulty depending upon which direction the exercise device is rolled. For example, a user can roll the device across a surface and experience a first range of resistive force for the movement, and then turn the exercise device around (rotate the device such that a wheel that was on the left side of the exercise device is now on the right side), and experience a second range of resistive force for the same movement. In some embodiments, the first range of resistive force can be higher than the second range of resistive force or can be lower. In some embodiments, a rate of change in the resistive force with displacement can be higher in first range of resistive force than the second range of resistive force or lower.

In some embodiments, an asymmetric force can be achieved by using different springs (or other energy storage devices) with different resistance force characteristics (e.g. spring constant, pressure chamber size, pressure chamber preload, spring preload, charger characteristics, motor characteristics, etc.) for movement in each direction, such as by utilizing a first spring (or other energy storage device) for loading in a first wheel rotation direction and a second spring (or other energy storage device for loading in a second wheel direction. Using the example of a compression spring, a spring on one side of the shuttle is loaded by wheel rotation in a first direction and a spring on the other side of the shuttle is loaded by wheel rotation in a second direction. Similar arrangements can be configured for other types of springs and other energy storage devices disclosed herein.

In some embodiments, an energy storage device can configured to have a preload where the energy storage device can provide a higher initial force for movement from the rest position or for a higher restoring force at the end of the shuttle's or wheel's travel back to the rest position. For example, by way of explanation, preloading a compression spring moves the spring to a point on the force-displacement graph where the displacement is not zero, and there for the force of the spring is higher than when displacement is zero. In some embodiments, additional features can be provided in the exercise device, to reduce the felt force of the energy storage system or to restrict the movement of the energy storage system. In some embodiments, a stop can be provided such that the spring or other energy storage device component does not push on the shuttle or wheel or exercise device at or near the rest position. In some embodiments, a friction surface can be provided proximate to the rest position that resists movement of the spring (or other energy storage device component) when the shuttle or wheel or exercise device is at or near the rest position. With the use of a friction surface, the friction surface can also act to increase the resistive force for movement from the rest position. In some embodiments, more than one feature can be used to resist movement or reduce felt force, such as for example using both a stop and a friction surface.

Rest Position

The exercise device can be present in a rest position where the energy storing device is not exerting a net torque to the wheel(s). In some embodiments, the energy storage device(s) (such as spring(s), pressure chamber(s), electrical storage unit(s), etc.) will not be loaded in the rest position. In some embodiments, the energy storage device(s) can be loaded while in the rest position, such as with springs, by placing one or more of the springs under tension or compression or otherwise deflecting the spring(s), yet still providing no net torque to the wheel(s). In some embodiments, this rest position can be accomplished by loading more than one energy storage device where the energy storage devices counter each other. In some embodiments one or more energy storage devices can be preloaded, but also be provided with a stop (physical or electrical) to reduce or prevent the exercise device from acting on or pushing the shuttle or wheel when the shuttle is in the rest position. In some embodiments, the use of a preload can result in a higher initial resistive force when the exercise device is initially moved from the rest position and/or provide a higher restoring force at or near the point where the exercise device returns to the rest position than if preloading were not used.

Energy Storage Device

The energy storage device used in an exercise device 41 can be any suitable device that can store energy from resisted motion (such as from pushing a device that resists motion) and then release the stored energy at a later time (such as by rotating the wheels of the exercise device to move the exercise device toward a rest position or a starting position.) As discussed herein, an energy storage device can be based on springs, with the springs being loaded and unloaded. In some embodiments, the energy storage device can utilize energy storage based upon another phenomena, such as pressure or volume, and in some embodiments, the pressure or volume of a gas. In some such embodiments, as a wheel turns, a pressure chamber linked to the wheel can increase in pressure when the energy storage device is loading energy and can decrease in pressure when the energy storage device is unloading energy. In some embodiments, the chamber can be linked through a shaft to the movement of the wheel, for example with rotation of the shaft, such as a shaft linked to a wheel through a spur gear or wheel as in FIG. 8B, 9A, 10B, 12, 13 or 14.

In some embodiments energy storage device can include a piston and chamber configured to change the pressure within the chamber by increasing the pressure when loading the energy storage device and decreasing the pressure in the chamber when unloading the energy storage device. In some embodiments, decreasing the pressure in the chamber can load the energy storage device and increasing the pressure in the chamber can unload the energy storage device. In some embodiments, the piston can be in communication with the shuttle 57 or lead nut 55" or the body 45. In some embodiments, the chamber can be in communication with the shuttle 57 or the lead nut 55" or the body 45. In some embodiments, the pressure in the chamber can be at or near atmospheric pressure when the exercise device is in the rest position. In some embodiments, the pressure in the chamber can be at a pressure above atmospheric pressure when the exercise device is in the rest position.

In some embodiments, the shuttle 57 or lead nut 55" can be moved along the lead screw 55' to change a pressure in the chamber. In some embodiments, the piston can be moved along an inside of the chamber to change the pressure in the chamber. The pressure in the chamber can be above atmospheric pressure, at atmospheric pressure or below atmospheric pressure.

In some embodiments, changing the pressure in the chamber can change the torque to the first and second wheels. For example, increasing or decreasing the pressure in the chamber can increase or decrease the torque to the first and/or second wheels 73, 74. In some embodiments, the pressure in the chamber can apply a load to the piston, thereby applying a load to the shuttle or lead nut so that the lead nut applies a torque to the lead screw, or the pressure in the chamber can apply a load to the chamber, thereby applying a load to the shuttle or lead nut.

In some embodiments, the energy storage device can store electrical energy. In some embodiments, the energy storage device can include the use of a battery and/or the use of a capacitor and/or other device that can hold an electrical charge. In some embodiments energy from movement of one or more of the wheels of the exercise platform can be stored and then released to assist movement of the platform in a return direction or to provide a force tending to move the platform in a return direction, but which can be resisted by the user of the platform. In some embodiments an electrical storage medium, such as a battery or a capacitor, etc., can be used to store the energy. In some embodiments, additional features can include suitable devices (not all might be present in any particular embodiment) such as a motor, charger (e.g. generator), a piezoelectric device and the like to convert the movement of the wheel into electrical energy and to convert electrical energy back into movement and to convert stored electrical energy into movement, along with levers, wheels, shafts, clutches, pawls, anchor points, bands, gears and the like so as to transfer at least a portion of the energy of the movement of the wheels to the motor, generator, piezoelectric device, etc. where the movement is converted into electrical energy and stored in the battery and/or capacitor, and then to transfer the movement of the motor, generator, piezoelectric device from the stored electrical energy back to the wheels in the form of rotation or torque.

In some embodiments, a charger can be a generator or alternator that converts rotational energy into electrical energy through the use of magnetic interaction. In some embodiments, a charger can be a device based upon the piezoelectric effect, such as a piezoelectric charger. In some embodiments, the motor can be a linear movement motor, a rotary motion motor, a piezoelectric motor, or other suitable device to convert electric energy into movement through, for example voltage, potential and/or current.

In some embodiments, the energy can be stored in the form of thermal energy, such as through the use of a thermoelectric device where the rotation of the wheel is used to generate electrical energy, such as with a charger, which is then used to heat or cool a thermal storage device (e.g. heat sink, etc.) upon movement of the wheel away from a rest position, and causing a resistive torque to be applied to the wheel. Upon movement of the wheel toward the rest position, the thermal electric device then utilizes the heat or cooling stored in the thermal storage device to convert thermal energy into electrical energy to turn a motor to apply torque to the wheel and urge the wheel toward the rest position.

Variable Torque

In some embodiments, if the torque to the lead screw is changed, the torque to the shaft can be changed. In some embodiments, if the torque to the shaft is changed, the torque to the first and second wheels can be changed, for example, if changing the torque to the shaft changes the torque to the first and second spur wheels. In some embodiments, the energy storage device can provide a constant torque or approximately constant torque to the first and or second wheel, such as by use of a constant spring or a spring arrangement that provides a constant load throughout the deflection of the spring.

Brake

In some embodiments, the exercise device can further include an optional brake to inhibit movement of at least one of the first and second wheels 73, 74. In some embodiments, this brake can provide a form of resistance to movement of the exercise device 41 in addition to the resistance provided by the energy storage system. In some embodiments, the brake can be configured to reduce an angular acceleration or angular velocity of the first and second wheels during operation. Suitable braking systems can include those that convert one form of energy to another, such as those based upon movement of air (e.g. fans) or those based on magnetic forces (e.g. eddy current devices), or viscous flow (e.g. hydraulic systems), etc. In some embodiments, the brake can be operationally connected to one or more of the wheels or to an axle or shaft extending from a wheel.

In some embodiments, such as is shown in FIG. 12, an optional eddy current brake can be located in the exercise device. In the embodiment of FIG. 12, the eddy current brake comprises a magnet 99 and a conductor 101. In some embodiments, the locations of the magnet 99 and conductor 101 shown in FIG. 12 can be reversed. In some embodiments, the magnet can be a series of magnets and the conductor can be a series of conductors. In some embodiments, the magnet and the conductor can be separately attached to a rotating part and a second rotating part or a stationary part of the exercise device 41, so as to have relative motion between the magnet and the conductor. In some embodiments, the rotating part can be a wheel or a shaft (either shaft 55 or another shaft that rotates with one of the wheels), a second rotating part can be a shaft (either shaft 55 or another shaft), and the stationary part can be a part of the wheel assembly, a part of the body 45 or the wheel assembly 64 of the exercise device.

In some embodiments, more than one brake can be present and in some particular embodiments, more than one eddy current brake can be present.

Double Shaft Embodiment

Figure 10A:
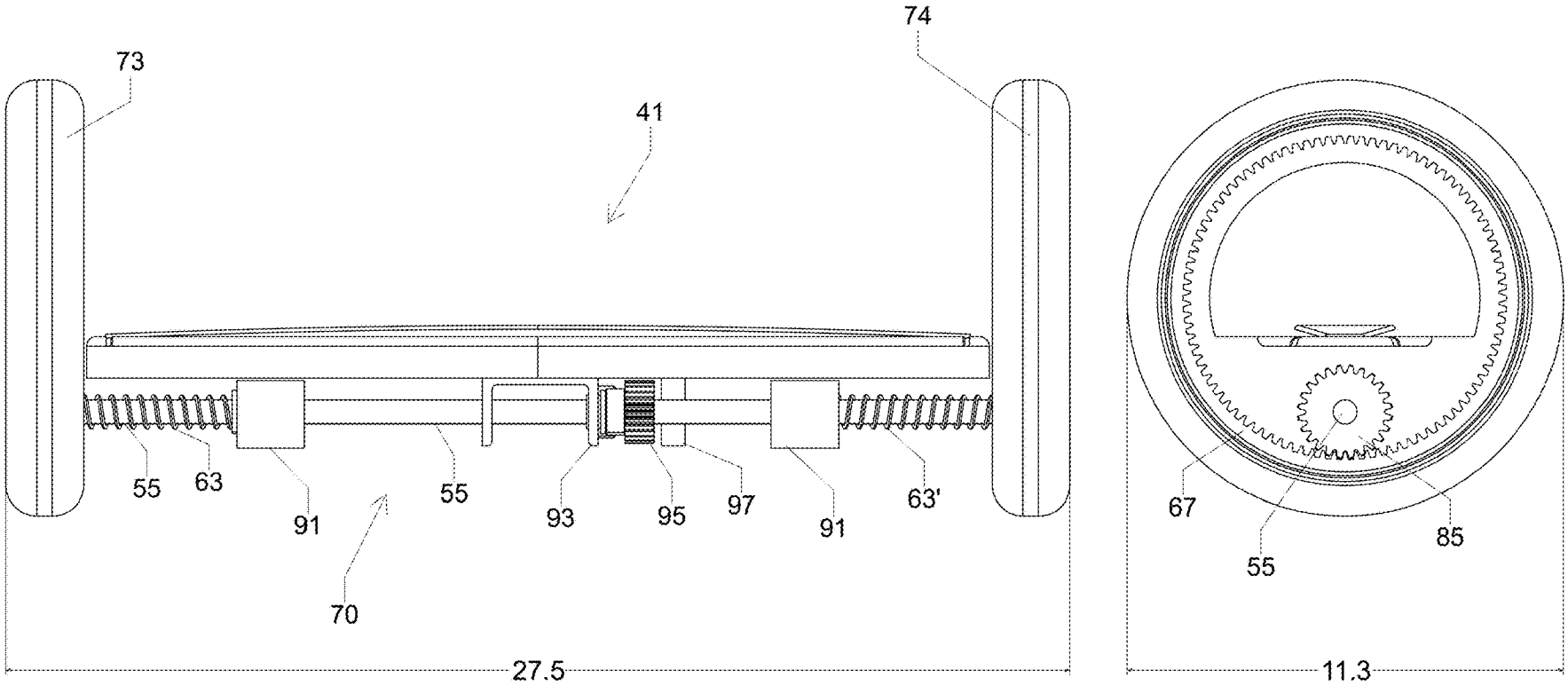
FIGS. 10A-D show an embodiment of an exercise device.
Figure 10B:
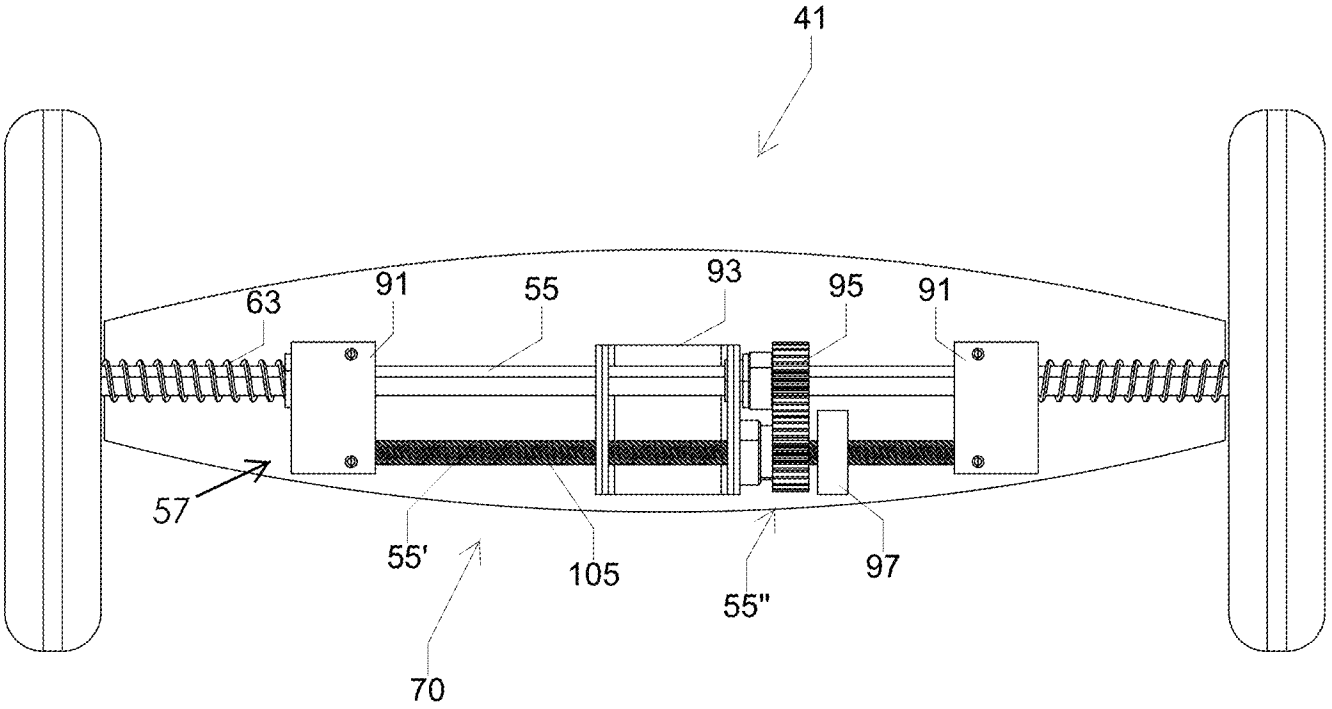
Figure 10C:
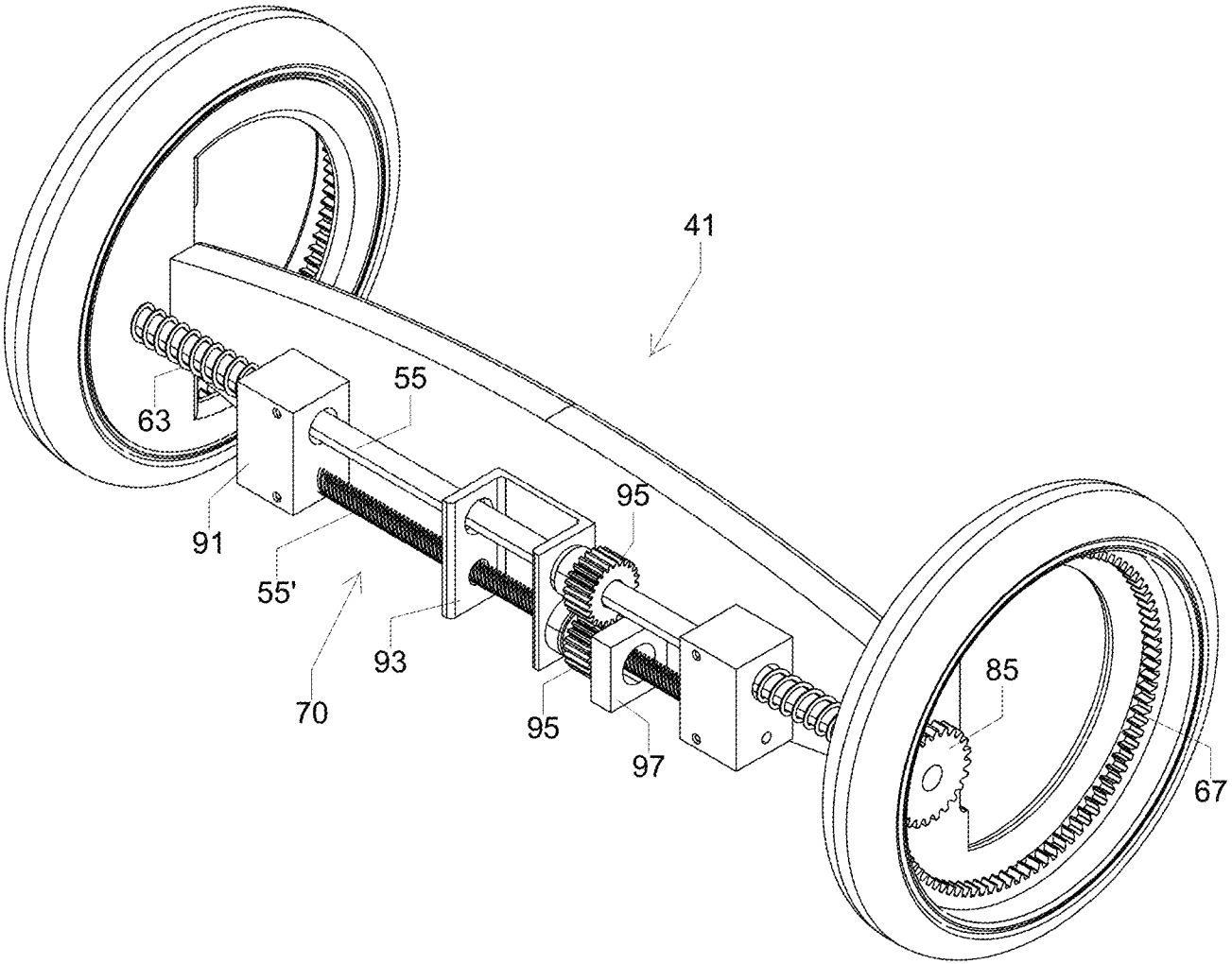
Figure 10D:
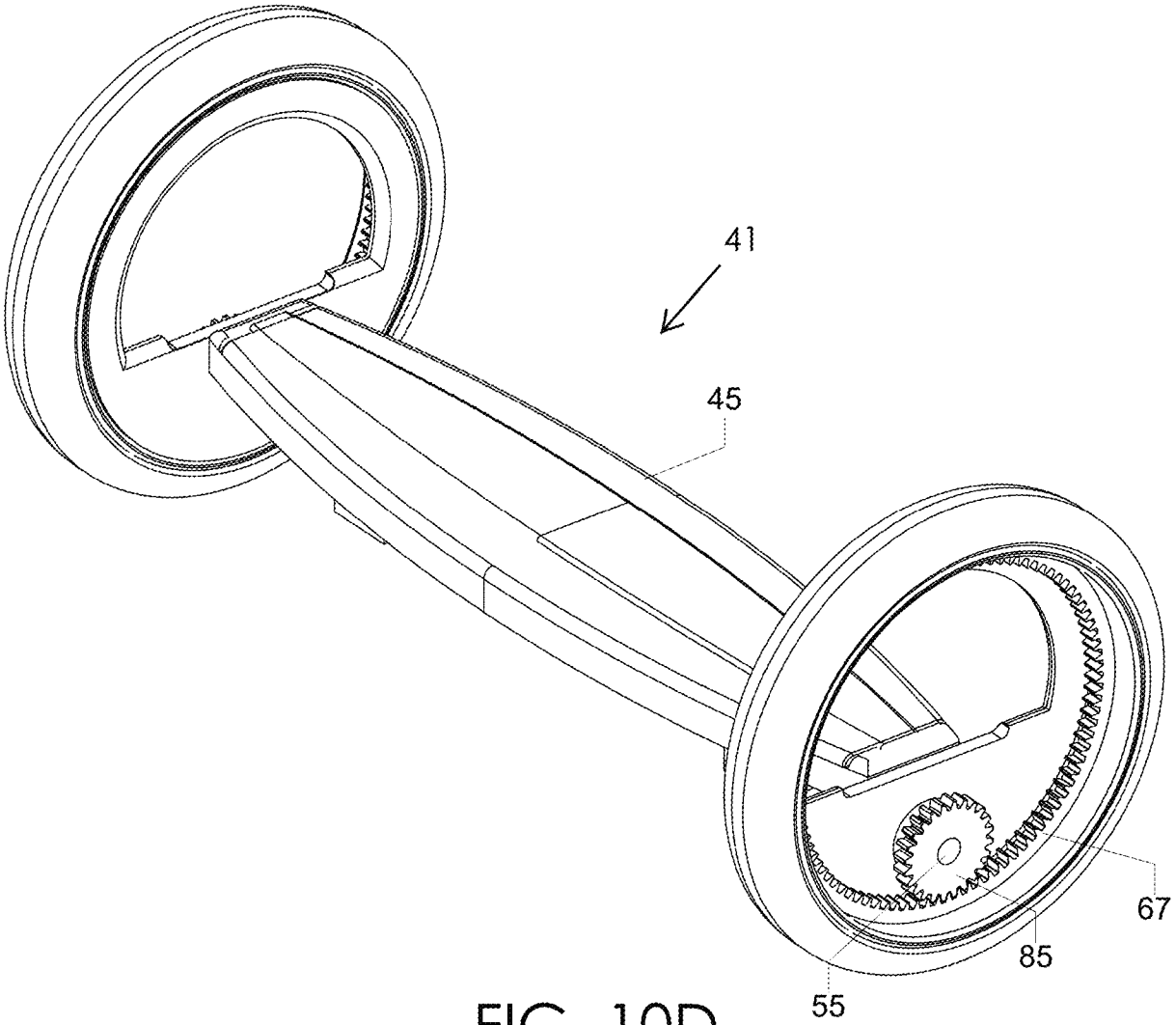
Figure 11A:
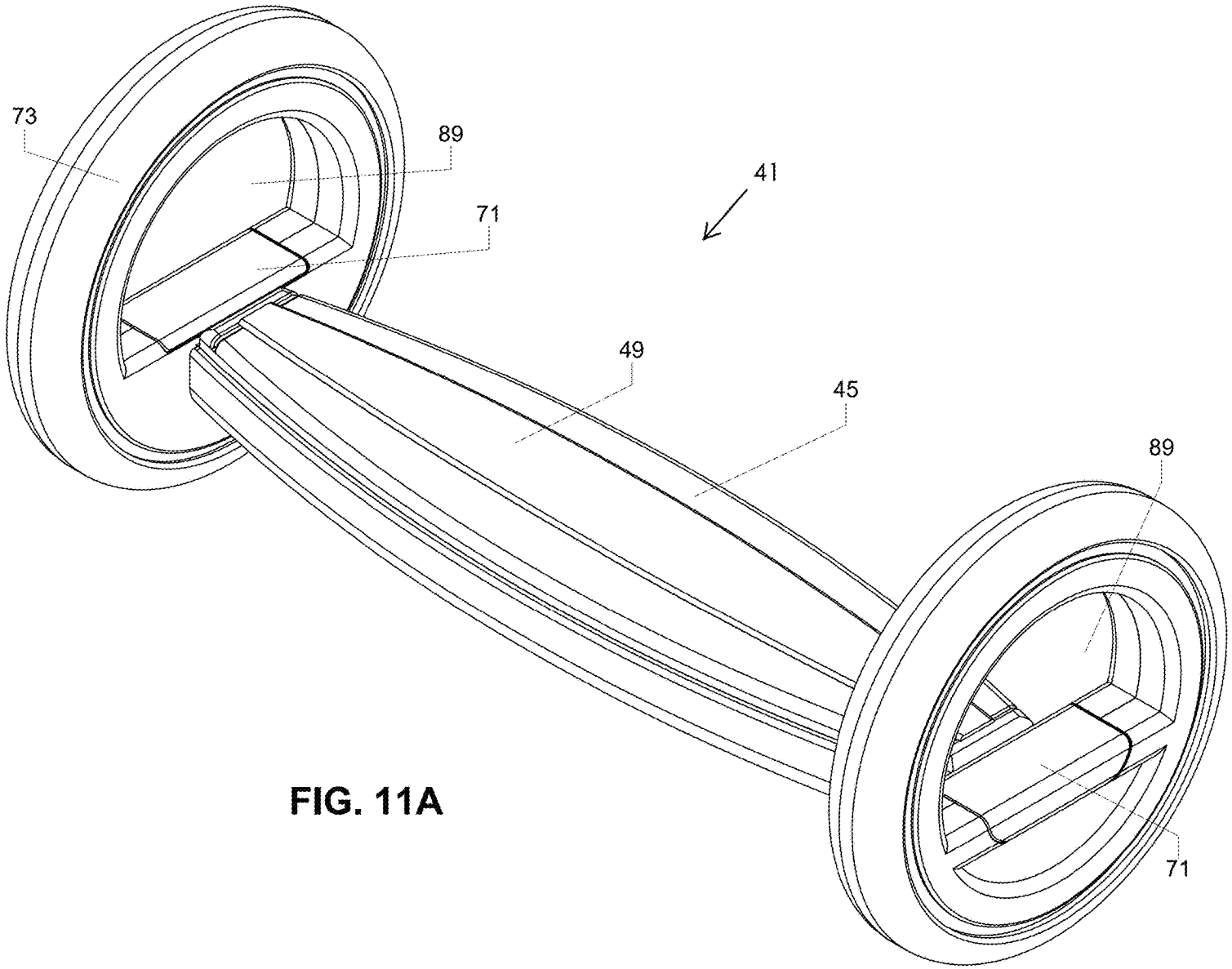
FIGS. 11A-D show an embodiment of an exercise device.
Figure 11B:
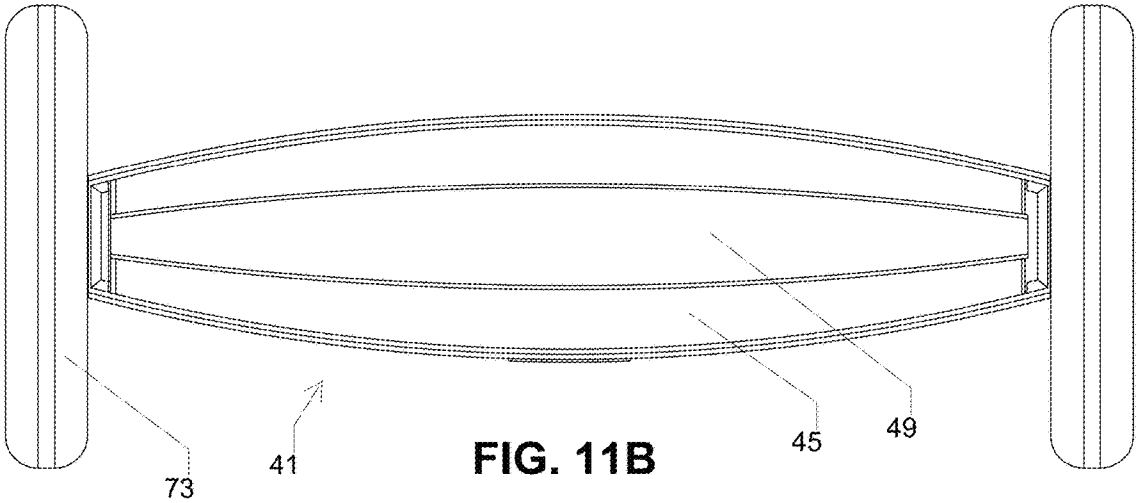
Figure 11C:
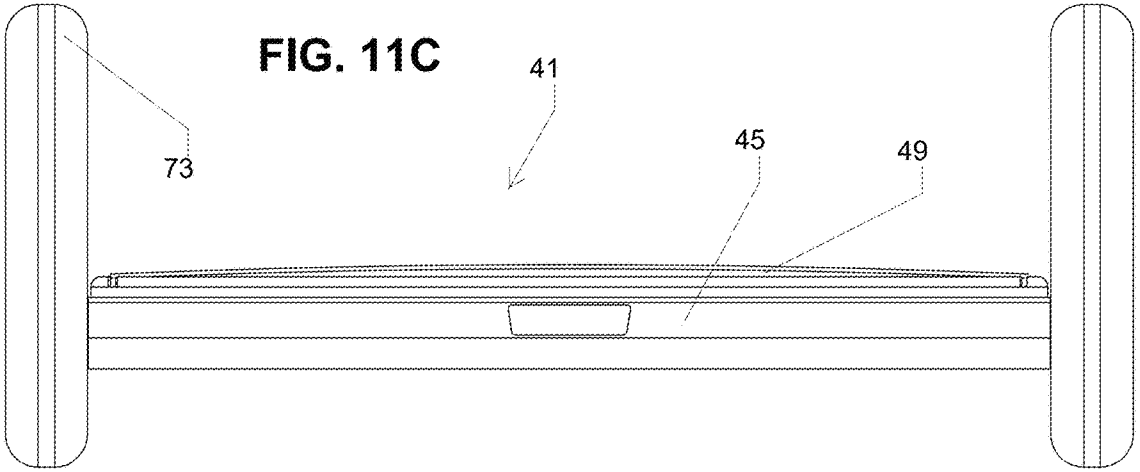
Figure 11D:
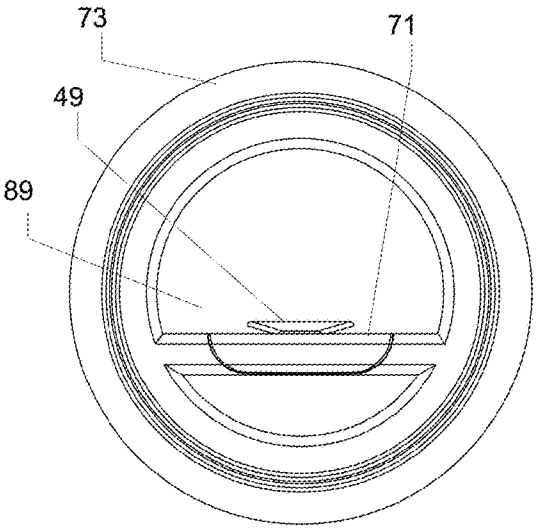

FIGS. 10A and 10B show an embodiment utilizing a double shaft arrangement of the exercise device 41. In FIG. 10A, the shaft 55 is rotationally locked to the first and second wheels 73, 74. The shuttle 57 comprises two end blocks 91 positioned on or adjacent the shaft 55. A second shaft 105 runs from one of the end blocks 91 to the second end block 91. Connecting the end blocks 91 is a gear mount 93. The gear mount has a series of transfer gears attached thereto to transfer rotational motion of the shaft 55 to a second shaft 105. The second shaft 105 can comprise a second shaft lead screw 55'. A lead nut 55" can be located, for example, in a transfer gear 95, the gear mount 93 and one or both end blocks 91.

The set of transfer gears can be a set of two gears or a set of more than two gears, with a first gear 95 located on the shaft and a second gear 95 located on the second shaft 105. In some embodiments, the first gear 95 can be mounted onto the shaft 55 by any suitable means such that the first gear 95 will rotate with the shaft 55. In some embodiments, the first gear 95 can be allowed to slide longitudinally along the shaft 55. The first gear 95 can also rotate in relation to the gear mount 93.

In some embodiments, the second gear 95 will include or will turn a second lead nut 55" which in turn moves the second shaft 105 toward one of the first and second wheels 73, 74 or the other. With this arrangement of the second gear 95 and the lead nut, the movement of the second shaft 105 moves the end blocks 91 toward the first wheel 73 or the first wheel 73 or the second wheel 74, loading or unloading the first and second springs 63, 63' (or just one spring if only one spring is present.)

In some embodiments employing a different operational sequence, rotation of the second gear 95 will rotate the second shaft 105, with one or both end blocks including a lead nut 55", and the lead nut moving the end block(s) 91 along the second shaft 105 and thereby loading or unloading the first and second springs 63, 63' (or just one spring if only one spring is present.)

Also shown in FIGS. 10A and 10B is a bumper 97 to act as a stop for the travel of the end blocks in relation to the transfer gears and gear mount.

As discussed in other embodiments, the first and second springs 63, 63' can be affixed at one end, both ends or no ends. The springs can be loaded by compression or by extension. When an end of the spring is affixed, it can be affixed as described herein, such as to the wheel assembly, to the body, to the end block or to the lead nut.

Gears

The gears used herein can utilized any appropriate type and shape of tooth suitable for the service for which they are employed. For example, the spur gears can be straight-cut or helical or any other relevant tooth shape or cut to work in the service they are provided for and to interface with the gears that they are paired with.

Strap

The exercise device 41 can also have a strap 49 extending along the body 45. The strap 49 can be sized and configured to provide a handhold or foothold or can act as a retainer for a hand, foot or other body part, such as by allowing a person using the exercise device 41 to locate one or more hands, feet or other parts under the strap to help maintain contact with the exercise device 41 during use. In some embodiments, the strap 49 can be affixed to the exercise device, such as by having a first strap end 103 and a second strap end 104 attached to respective first and second ends 56, 58 of the body 45 or affixed to the body proximate the respective first and second ends of the body 45.

Body and Wheel Assembly Further Embodiments

FIGS. 11A-D, 15A-D, 16A-E, 17A-E and 18A-F show further designs of the exercise device. In various embodiments, one or both of the wheels or wheel assemblies shown in FIGS. 11A-D, 15A-D, 16A-E, 17A-E and 18A-F can be used with other embodiments of an exercise device of FIGS. 11A-D, 15A-D, 16A-E, 17A-E and 18A-F or disclosed elsewhere herein. In various embodiments, the body of an exercise device of FIGS. 11A-D, 15A-D, 16A-E, 17A-E and 18A-F can be used with other embodiments of an exercise device of FIGS. 11A-D, 15A-D, 16A-E, 17A-E and 18A-F or disclosed elsewhere herein. In various embodiments, the strap or other features described herein can be combined with an exercise device of FIGS. 11A-D, 15A-D, 16A-E, 17A-E and 18A-F.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. Use of language such as "approximately", "somewhat", "about", "nearly" and other terms of degree that appear within this disclosure are intended to be interpreted as a person of skill in the art would understand the language based upon the context, with a further understanding that if the context provides insufficient guidance, a tolerance of 20% should be applied. Use of the word "or" should be understood to also include the meaning "and", except where the context indicates otherwise. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims.

Concepts

Concept 1. An exercise device comprising:

a body, the body having a top, a bottom, a first end located at one edge of the body, a second end located at an opposite end of the body, and first and second sides extending between the first and second ends;

first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub;

a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end;

when the first and second wheels are rotated against respective first and second spring torques, energy is stored in the first and second springs and the first and second springs apply restoring torque to the first and second wheels, respectively.

Concept 2. An exercise device comprising:

a body, the body having a top, a bottom, a first end located at one edge of the body, a second end located at an opposite end of the body, and first and second sides extending between the first and second ends;

a first axle connected to a first wheel, the first axle also connected to the body proximate the first end at a first hub;

a first spring having a first spring end, the first spring positioned at least partially within the first axle, with the first spring end slidably connected to one of the first wheel and the first hub at a first junction, wherein the first junction is configured to convey torque between the one of the first hub and the first wheel and the first spring end.

Concept 3. The exercise device of Concept 2, wherein the first spring comprises a second spring end opposite the first spring end, and the first spring end is slidably connected to one of the first hub and first wheel and the second spring end is slidably connected to the other of the first hub and first wheel at a second junction, wherein the second junction is configured to transfer torque between the other of the first hub and the first wheel and the second spring end.

Concept 4. The exercise device of Concept 2, wherein the first junction is a slot configured to receive the first spring end.

Concept 5. The exercise device of Concept 3, wherein the second junction is a slot configured to receive the second spring end.

Concept 6. The exercise device of Concept 2, wherein the first axle is rotationally locked to the first wheel.

Concept 7. The exercise device of Concept 2, wherein the first spring is contained entirely within the first axle.

Concept 8. The exercise device of Concept 2, wherein the body is sized and configured for two feet to be placed upon the body and for the feet to push the body; and the first wheel has a neutral position wherein the first spring does not apply torque to the first wheel, and when the first wheel is rotated away from the neutral position, energy is stored in the first spring and the first spring applies a restoring torque to the first wheel.

Concept 9. The exercise device of Concept 3, wherein the wheel comprises a spring cover and the junction or the second junction is located in the spring cover.

Concept 10. The exercise device of Concept 2, further comprising:

a second wheel, a second axle and a second spring;

wherein the second axle is connected to the second wheel, the second axle is also connected to the body proximate the second end of the body at a second hub;

the second spring having a first spring end, the second spring positioned at least partially within the second axle, with the first spring end of the second spring slidably connected to one of the second wheel and the second hub at a third junction, wherein the third junction is configured to convey torque between the one of the second hub and the second wheel and the first spring end of the second spring.

Concept 11. The exercise device of Concept 10, wherein:

the second spring further comprises a second spring end opposite the first spring end of the second spring; and the second spring end of the second spring is slidably connected to the other of the second wheel and the second hub at a fourth junction, wherein the fourth junction is configured to convey torque between the other of the second hub and the second wheel and the second spring end.

Concept 12. The exercise device of Concept 2, wherein the first spring is located above the body when the body top is facing up.

Concept 13

The exercise device of Concept 2, wherein the first spring is located below the body when the body top is facing up.

Concept 14. The exercise device of Concept 2, wherein the first spring is located at least partially within the first wheel.

Concept 15. The exercise device of Concept 2, wherein the first spring is located entirely within the first wheel.

Concept 16. The exercise device of Concept 2, wherein the first spring is a coil spring.

Concept 17. A method of using the exercise device of Concept 1 comprising:

moving the exercise device away from a person's waist while the person's feet are placed on the body of the exercise device and the first and second wheels are on a surface, wherein when the exercise device is moved away from the person's waist, the first and second wheels rotate along the surface, and torque energy is stored in the first and second springs; and moving the exercise device toward the person's waist while the person is assisted by or resists torque supplied to the first and second wheels by the first and second springs, respectively.

Concept 18. An exercise device comprising:

a body, the body having a top, a bottom, a first end located at one edge of the body, a second end located at an opposite end of the body, and first and second sides extending between the first and second ends;

first and second axles connected to and rotationally locked to first and second wheels, respectively, the first and second wheels able to rotate both in clockwise and counterclockwise directions in relation to the body, the first axle also connected to the body proximate the first end at a first hub and the second axle also connected to the body proximate the second end at a second hub;

a first spring with a wheel end and a hub end, the first spring positioned at least partially within the first axle, with the first spring wheel end slidably connected to the first wheel at a first wheel junction, wherein the first wheel junction is configured to convey torque between the first wheel and the first spring wheel end, and the first spring hub end slidably connected to the first hub at a first hub junction, wherein the first hub junction is configured to convey torque between the first hub and the first spring hub end; and a second spring with a wheel end and a hub end, the second spring positioned at least partially within the second axle, with the second spring wheel end slidably connected to the second wheel at a second wheel junction, wherein the second wheel junction is configured to convey torque between the second wheel and the second spring wheel end, and the second spring hub end slidably connected to the second hub at a second hub junction, wherein the second hub junction is configured to convey torque between the second hub and the second spring hub end;

when the first and second wheels are rotated against respective first and second spring torques, energy is stored in the first and second springs and the first and second springs apply restoring torque to the first and second wheels, respectively.

Concept 19. An exercise device comprising:

a body, the body having a top, a bottom, a first end located at one edge of the body, a second end located at an opposite end of the body, and first and second sides extending between the first and second ends;

a first axle connected to a first wheel, the first axle also connected to the body proximate the first end at a first hub;

a first spring having a first spring end, the first spring positioned at least partially within the first axle, with the first spring end slidably connected to one of the first wheel and the first hub at a first junction, wherein the first junction is configured to convey torque between the one of the first hub and the first wheel and the first spring end.

Concept 20. The exercise device of Concept 19, wherein the first spring comprises a second spring end opposite the first spring end, and the first spring end is slidably connected to one of the first hub and first wheel and the second spring end is slidably connected to the other of the first hub and first wheel at a second junction, wherein the second junction is configured to transfer torque between the other of the first hub and the first wheel and the second spring end.

Concept 21. The exercise device of Concept 19 or 20, wherein the first junction is a slot configured to receive the first spring end.

Concept 22. The exercise device of any one of Concepts 20-21, wherein the second junction is a slot configured to receive the second spring end.

Concept 23. The exercise device of any one of Concepts 19-22, wherein the first axle is rotationally locked to the first wheel.

Concept 24. The exercise device of any one of Concepts 19-23, wherein the first spring is contained entirely within the first axle.

Concept 25. The exercise device of any one of Concepts 19-24, wherein the body is sized and configured for two feet to be placed upon the body and for the feet to push the body; and the first wheel has a neutral position wherein the first spring does not apply torque to the first wheel, and when the first wheel is rotated away from the neutral position, energy is stored in the first spring and the first spring applies a restoring torque to the first wheel.

Concept 26. The exercise device of Concept 19 or 20, wherein the first wheel comprises a spring cover and the first junction or the second junction is located in the spring cover.

Concept 27. The exercise device of any one of Concepts 19-26, wherein the first spring is located above the body when the body top is facing up.

Concept 28. The exercise device of any one of Concepts 19-27, wherein the first spring is located below the body when the body top is facing up.

Concept 29. The exercise device of any one of Concepts 19-28, wherein the first spring is located at least partially within the first wheel.

Concept 30. The exercise device of any one of Concepts 19-29, wherein the first spring is located entirely within the first wheel.

Concept 31. The exercise device of any one of Concepts 19-30, wherein the first spring is a coil spring.

Concept 32. The exercise device of any one of Concepts 19-31-14, further comprising:

a second wheel, a second axle and a second spring;

wherein the second axle is connected to the second wheel, the second axle is also connected to the body proximate the second end of the body at a second hub;

the second spring having a first spring end, the second spring positioned at least partially within the second axle, with the first spring end of the second spring slidably connected to one of the second wheel and the second hub at a third junction, wherein the third junction is configured to convey torque between the one of the second hub and the second wheel and the first spring end of the second spring.

Concept 33. The exercise device of Concept 32, wherein:

the second spring further comprises a second spring end opposite the first spring end of the second spring; and the second spring end of the second spring is slidably connected to the other of the second wheel and the second hub at a fourth junction, wherein the fourth junction is configured to convey torque between the other of the second hub and the second wheel and the second spring end.

Concept 34. A method of using the exercise device of Concept 18 comprising:

moving the exercise device away from a person's waist while the person's feet are placed on the body of the exercise device and the first and second wheels are on a surface, wherein when the exercise device is moved away from the person's waist, the first and second wheels rotate along the surface, and torque energy is stored in the first and second springs; and moving the exercise device toward the person's waist while the person is assisted by or resists torque supplied to the first and second wheels by the first and second springs, respectively Concept 35. An exercise device comprising:

a body, the body having a top, a bottom, a first end located at an edge of the body, a second end located at an opposite edge of the body, and first and second sides extending between the first and second ends;

a first wheel assembly comprising a first wheel, the first wheel assembly connected to the body proximate the first end;

a second wheel assembly comprising a second wheel, the second wheel assembly connected t the body proximate the second end;

a shaft in rotational communication with the first wheel and the second wheel, the shaft rotationally locked to the first wheel;

a shuttle configured to move along the shaft upon rotation of the first or second wheel;

a first spring, wherein the exercise device is configured for the first spring to be loaded and unloaded by the moving of the shuttle along the shaft wherein when the first wheel is rotated in relation to the body from a rest position, the shaft rotates, moving the shuttle which loads the first spring which applies a resisting torque to the first wheel, and when the first wheel is moved or allowed to move back to the rest position, the spring applies a restoring torque to the wheel through the shuttle and the shaft to urge the wheel toward the rest position.

Concept 36. The exercise device of Concept 35, wherein the first wheel, the second wheel and the shaft are rotationally locked to one another.

Concept 37. The exercise device of Concept 35, wherein the shaft comprises a lead screw and the shuttle comprises a lead screw nut in threaded communication with the lead screw.

Concept 38. The exercise device of Concept 35, wherein the spring is a coil spring and the shaft passes through the coil spring, with coils of the coil spring encircling the shaft.

Concept 39. The exercise device of Concept 37, wherein the coil spring is located between the shuttle and the first wheel or the second wheel.

Concept 40. The exercise device of Concept 35, further comprising a second spring, the exercise device is configured for the second spring to be loaded and unloaded by the moving of the shuttle along the shaft.

Concept 41. The exercise device of Concept 40, wherein as the first spring is loaded, the second spring is unloaded.

Concept 42. The exercise device of Concept 40, wherein the first spring is a coil spring and the shaft passes through the coil spring, with the coils of the coil spring encircling the shaft, and the second spring is a coil spring, with the coils of the coil spring encircling the shaft, and during operation, the first spring is loaded by compression and the second spring is loaded by extension.

Concept 43. The exercise device of Concept 36, further comprising:

a first spur wheel rotationally locked to the shaft and in rotational communication with a surface of the first wheel; and a second spur wheel rotationally locked to the shaft and in rotational communication with a surface of the second wheel.

Concept 44. The exercise device of Concept 43, wherein the first and second spur wheels are spur gears and the inner surfaces of the first and second wheels have geared surfaces that engage the first and second spur gears, respectively.

Concept 45. The exercise device of Concept 35, further comprising first and second hand grips, wherein each of the first and second hand grips is located adjacent to the respective first and second ends of the body and allow a hand of a user to pass through a wheel plane of the respective first or second wheel while the hand of the user grips the exercise device.

Concept 46. The exercise device of Concept 35, wherein the first and second wheel assemblies further comprise first and second axles, respectively, and the first axle is connected to and rotationally locked to the first wheel and the second axle is connected to and rotationally locked to the second wheel.

Concept 47. The exercise device of Concept 35, wherein a wheel assembly further comprises an eddy current brake positioned within the first wheel assembly, wherein the eddy current brake is configured to reduce the rotational speed of the first wheel during operation.

Concept 48. The exercise device of Concept 47, wherein the eddy current brake comprises a magnet and a conductor, wherein the magnet rotates as the first wheel rotates, and the magnet and the conductor rotate in relation to one another during operation and the conductor is optionally affixed to a non-rotating part of the exercise device; or the conductor rotates as the first wheel rotates, and the magnet and the conductor rotate in relation to one another during operation and the conductor is optionally affixed to a non-rotating part of the exercise device.

Concept 49. The exercise device of Concept 48, wherein the conductor comprises metallic material.

Concept 50. The exercise device of Concept 35, wherein the shaft does not comprise the first axle or the shaft does not comprise the first and second axle.

Concept 51. The exercise device of Concept 35, wherein the shuttle comprises a second shaft, first and second end blocks, a gear mount and first and second transfer gears, wherein each of the first and second end blocks move along the shaft and are rotatingly anchored to the second shaft, the gear mount is located between the first and second end blocks, the first transfer gear is mounted to the gear mount and is rotationally locked with the shaft while engaging the second transfer gear which is mounted to the slider, and i) the second shaft comprises a lead screw with the second gear having a corresponding lead nut, and upon rotation of the shaft, the first transfer gear rotates the second transfer gear which then moves the second shaft and the end blocks toward the first end of the body or the second end of the body, loading or unloading the first spring, or ii) the second shaft is comprises a lead screw and is rotationally locked to the second gear and upon rotation of the shaft, the first transfer gear rotates the second transfer gear which then rotates the shaft the second shaft first and second lead nuts located in the first and second end blocks cause the first and second end blocks to move toward the first end of the body or the second end of the body, loading or unloading the first spring.

Concept 52. The device of Concept 46, wherein the shaft is physically offset from the first axle.

Concept 53. The device of Concept 46, wherein the shaft is physically offset from the first and second axles.

Concept 54. An exercise device comprising:

a body, the body having a top, a bottom, a first end located at an edge of the body, a second end located at an opposite edge of the body, and first and second sides extending between the first and second ends;

a first wheel assembly comprising a first wheel, the first wheel assembly connected to the body proximate the first end;

a second wheel assembly comprising a second wheel, the second wheel assembly connected to the body proximate the second end;

a shaft in rotational communication with the first wheel and the second wheel, the shaft rotationally locked to the first wheel;

a first spring, wherein the exercise device is configured for the first spring to be loaded and unloaded by the rotation of the shaft, wherein when the first wheel is rotated in relation to the body from a rest position, the shaft rotates and torsionally deflecting an end of the spring which loads the spring which applies a resisting torque to the first wheel, and when the first wheel is moved or allowed to move back to the rest position, the spring applies a restoring torque to the wheel through the shaft to urge the wheel toward the rest position.

Concept 55. An exercise device comprising:

a body, the body having a top, a bottom, a first end located at an edge of the body, a second end located at an opposite edge of the body, and first and second sides extending between the first and second ends;

a first wheel assembly comprising a first wheel, the first wheel assembly connected to the body proximate the first end;

a second wheel assembly comprising a second wheel, the second wheel assembly connected to the body proximate the second end;

a shaft in rotational communication with the first wheel and the second wheel, the shaft rotationally locked to the first wheel;

an energy storage device, comprising a gas in a chamber, wherein the exercise device is configured for the energy storage device to be loaded and unloaded by the rotation of the shaft, wherein when the first wheel is rotated in relation to the body from a rest position, the shaft rotates and increases a pressure within the chamber which applies a resisting torque to the first wheel through the shaft, and when the first wheel is moved or allowed to move back to the rest position, the pressure within the chamber applies a restoring torque to the wheel through the shaft to urge the wheel toward the rest position.

Concept 56. An exercise device comprising:

a body, the body having a top, a bottom, a first end located at an edge of the body, a second end located at an opposite edge of the body, and first and second sides extending between the first and second ends;

a first wheel assembly comprising a first wheel, the first wheel assembly connected to the body proximate the first end;

a second wheel assembly comprising a second wheel, the second wheel assembly connected to the body proximate the second end;

a shaft in rotational communication with the first wheel and the second wheel, the shaft rotationally locked to the first wheel;

an energy storage device, comprising a battery or a capacitor, wherein the exercise device is configured for the energy storage device to be loaded and unloaded by the rotation of the shaft, wherein when the first wheel is rotated in relation to the body from a rest position, the shaft rotates and operates a charger, the charger increasing the electrical energy stored in the battery or capacitor, which in turn runs a motor that acts on the first wheel to apply a resisting torque to the first wheel through the shaft, and when the first wheel is moved or allowed to move back to the rest position, the motor a restoring torque to the wheel through the shaft to urge the wheel toward the rest position.

Concept 57. The exercise device of Concept 56, wherein the charger is a generator.

What is claimed is:

1. An exercise device comprising:

a body, the body having a top, a bottom, a first end located at an edge of the body, a second end located at an opposite edge of the body, and first and second sides extending between the first and second ends;

a first wheel assembly comprising a first wheel, the first wheel assembly connected to the body proximate to the first end;

a second wheel assembly comprising a second wheel, the second wheel assembly connected to the body proximate to the second end;

a shaft having opposing first and second shaft ends eccentrically and rotationally coupled to the first and second wheels, respectively, wherein the shaft is rotationally locked to the first and second wheels, and wherein the shaft extends from the first wheel to the second wheel;

a first energy storage device, wherein the exercise device is configured for the first energy storage device to be loaded and unloaded by a moving of the first wheel, wherein when the first wheel is rotated in relation to the body from a rest position, the first energy storage device is loaded and applies a resisting torque to the first wheel, and when the first wheel is moved or allowed to move back to the rest position, the first energy storage device applies a restoring torque to the first wheel to urge the first wheel toward the rest position.

2. The exercise device of claim 1, further comprising a shuttle configured to move along the shaft upon rotation of the first or second wheel.

3. The exercise device of claim 2, wherein the shaft comprises a lead screw and the shuttle comprises a lead screw nut in threaded communication with the lead screw.

4. The exercise device of claim 2, wherein the first energy storage device is a coil spring and the shaft passes through the coil spring, with coils of the coil spring encircling the shaft.

5. The exercise device of claim 4, wherein the coil spring is located between the shuttle and the first wheel.

6. The exercise device of claim 2, further comprising a second energy storage device, wherein the exercise device is configured for the second energy storage device to be loaded and unloaded by the moving of the shuttle along the shaft.

7. The exercise device of claim 6, wherein as the first energy storage device is loaded, the second energy storage device is unloaded.

8. The exercise device of claim 6, wherein the first energy storage device is a first coil spring and the shaft passes through the first coil spring, with coils of the first coil spring encircling the shaft, and the second energy storage device is a second coil spring, with coils of the second coil spring encircling the shaft, and during operation, the first energy storage device is loaded by compression and the second energy storage device is loaded by extension.

9. The exercise device of claim 2, wherein the shuttle comprises a second shaft, first and second end blocks, a gear mount and first and second transfer gears, wherein each of the first and second end blocks move along the shaft and are rotatingly anchored to the second shaft, the gear mount is located between the first and second end blocks, the first transfer gear is mounted to the gear mount and is rotationally locked with the shaft while engaging the second transfer gear which is mounted to the gear mount, and i) the second shaft comprises a lead screw with the second gear having a corresponding lead nut, and upon rotation of the shaft, the first transfer gear rotates the second transfer gear which then moves the second shaft and the end blocks toward the first end of the body or the second end of the body, loading or unloading the first energy storage device, or ii) the second shaft comprises a lead screw and is rotationally locked to the second gear and upon rotation of the shaft, the first transfer gear rotates the second transfer gear which then rotates the second shaft, with first and second lead nuts respectively located in the first and second end blocks causing the first and second end blocks to move toward the first end of the body or the second end of the body, loading or unloading the first energy storage device.

10. The exercise device of claim 2, wherein the first energy storage device comprises a gas in a chamber, and the exercise device is configured for the first energy storage device to be loaded and unloaded by rotation of the shaft, wherein when the first wheel is rotated in relation to the body from the rest position, the shaft rotates and increases a pressure within the chamber which applies the resisting torque to the first wheel through the shaft, and when the first wheel is moved or allowed to move back to the rest position, the pressure within the chamber applies the restoring torque to the first wheel through the shaft to urge the first wheel toward the rest position.

11. The exercise device of claim 1, wherein the first wheel has an inner surface, and a planetary gear set connects the first shaft end to the inner surface of the first wheel.

12. The exercise device of claim 1, further comprising first and second hand grips, wherein each of the first and second hand grips is located adjacent to the respective first and second ends of the body and allow a hand of a user to pass through a wheel plane of the respective first or second wheel while the hand of the user grips the exercise device.

13. The exercise device of claim 1, wherein the first and second wheel assemblies further comprise first and second axles, respectively, and the first axle is connected to and rotationally locked to the first wheel and the second axle is connected to and rotationally locked to the second wheel.

14. The exercise device of claim 13, wherein the shaft is distinct from the first and second axles.

15. The exercise device of claim 13, wherein the shaft is physically offset from the first axle.

16. The exercise device of claim 13, wherein the shaft is physically offset from the first and second axles.

17. The exercise device of claim 1, wherein the first wheel assembly further comprises an eddy current brake positioned within the first wheel assembly, wherein the eddy current brake is configured to reduce a rotational speed of the first wheel during operation.

18. The exercise device of claim 17, wherein the eddy current brake comprises a magnet and a conductor, wherein:

the magnet rotates as the first wheel rotates, and the magnet and the conductor rotate in relation to one another during operation; or the conductor rotates as the first wheel rotates, and the magnet and the conductor rotate in relation to one another during operation.

19. The exercise device of claim 18, wherein the conductor comprises metallic material.

20. The exercise device of claim 1, wherein the moving of the first wheel loads and unloads the first energy storage device by rotation of the shaft.

21. The exercise device of claim 1, wherein the first energy storage device is a torsion spring located within the first wheel.

* * * * *